US011037523B2

(12) United States Patent
Hei et al.

(10) Patent No.: US 11,037,523 B2
(45) Date of Patent: Jun. 15, 2021

(54) DISPLAY METHOD OF DISPLAY PANEL THAT USES DIFFERENT DISPLAY ALGORITHMS FOR DIFFERENT DISPLAY AREAS, DISPLAY PANEL AND DISPLAY DEVICE

(71) Applicant: WuHan TianMa Micro-electronics CO., LTD., Wuhan (CN)

(72) Inventors: Yajun Hei, Wuhan (CN); Yang Huang, Wuhan (CN); Jingxiong Zhou, Wuhan (CN); Ruiyuan Zhou, Wuhan (CN)

(73) Assignee: WUHAN TIANMA MICRO-ELECTRONICS CO., LTD., Wuhan (CN)

( * ) Notice: Subject to any disclaimer, the term of this patent is extended or adjusted under 35 U.S.C. 154(b) by 0 days.

(21) Appl. No.: 16/730,902

(22) Filed: Dec. 30, 2019

(65) Prior Publication Data

US 2021/0134242 A1 May 6, 2021

(30) Foreign Application Priority Data

Oct. 30, 2019 (CN) ..... 201911043411.8

(51) Int. Cl.
*G09G 5/02* (2006.01)

(52) U.S. Cl.
CPC ..... *G09G 5/02* (2013.01); *G09G 2300/0439* (2013.01); *G09G 2320/0242* (2013.01); *G09G 2320/0666* (2013.01)

(58) Field of Classification Search
None
See application file for complete search history.

(56) References Cited

U.S. PATENT DOCUMENTS

2014/0168037 A1* 6/2014 Sakariya ..... G09G 3/3233 345/82
2017/0076654 A1* 3/2017 Wang ..... G09G 3/2074
2018/0136720 A1* 5/2018 Spitzer ..... G06T 1/20

FOREIGN PATENT DOCUMENTS

CN 108766347 A 11/2018

* cited by examiner

*Primary Examiner* — Kirk W Hermann
(74) *Attorney, Agent, or Firm* — Christensen O'Connor Johnson Kindness PLLC

(57) ABSTRACT

A display method of a display panel is described. The display panel has a first display area and a second display area, first sub-pixels are located in the first display area and second sub-pixels are located in the second display area, and a sub-pixel density of the second display area is smaller than that of the first display area. The display method includes: in displaying one frame of image, performing display in the first display area and the second display area by using different display algorithms. A sub-pixel rendering is used to perform display in at least one of the first display area and the second display area. A number of data signals provided to the first display area and a number of the first sub-pixels are identical. A number of data signals provided to the second display area and a number of the second sub-pixels are identical.

14 Claims, 13 Drawing Sheets

DISPLAY METHOD OF DISPLAY PANEL THAT USES DIFFERENT DISPLAY ALGORITHMS FOR DIFFERENT DISPLAY AREAS, DISPLAY PANEL AND DISPLAY DEVICE

CROSS-REFERENCE TO RELATED APPLICATIONS

The present disclosure claims priority to Chinese Patent Application No. 201911043411.8, filed on Oct. 30, 2019, the content of which is incorporated herein by reference in its entirety.

TECHNICAL FIELD

The present disclosure relates to the field of display technologies, and in particular, to a display method of a display panel, a display panel and a display device.

BACKGROUND

For display technologies in the related art, conventionally an under-screen optical element is used in which the optical element is arranged under a display area, thereby saving space of a non-display area and, thus, increasing a screen occupancy ratio to achieve a full screen. The under-screen optical element may be, for example, a camera, a fingerprint sensor, etc. Where the under-screen optical element is a camera as an example, when an image is normally displayed, such normal display can be performed in an area in which the camera is located. When the camera is enabled, light passes through the display panel and is then collected by the camera to achieve a function of imaging or photographing.

Since a light transmission area in the display area is limited, in order to improve light transmittance and optical performance of the under-screen optical element, a conventional arrangement reduces a sub-pixel density of the area in which the optical element is located. In other words, the display area of the display panel has different pixel densities. Some conventional display panels have a color shift problem during display, which affects a display effect thereof.

SUMMARY

In view of this, embodiments of the present disclosure provide a display method for a display panel, a display panel, and a display device, so as to solve the problem of display color shift that occurs during display using conventional display panels.

In a first aspect, an embodiment of the present disclosure provides a display method of a display panel. The display panel has a display area, and the display area includes a first display area and a second display area, sub-pixels provided in the display area include first sub-pixels and second sub-pixels, the first sub-pixels are located in the first display area and the second sub-pixels are located in the second display area, and a sub-pixel density of the second display area is smaller than a sub-pixel density of the first display area; the display panel includes a pixel circuit electrically connected to the sub-pixels to drive the sub-pixels to perform display. The display method includes: in displaying one frame of image, performing display in the first display area and the second display area by using different display algorithms, wherein a sub-pixel rendering is used to perform display in at least one of the first display area and the second display area. A number of data signals provided to the first display area and a number of the first sub-pixels are identical, a number of data signals provided to the second display area and a number of the second sub-pixels are identical, and when the pixel circuit drives the sub-pixels to perform display, a voltage signal written by a data line to the pixel circuit is determined as a data signal.

In another aspect, an embodiment of the present disclosure further provides a display panel that performs display by using the display method described in any embodiment of the present disclosure.

In yet another aspect, an embodiment of the present disclosure further provides a display device including the display panel described in any embodiment of the present disclosure.

BRIEF DESCRIPTION OF DRAWINGS

In order to more clearly illustrate technical solutions in embodiments of the present disclosure, the accompanying drawings used in the embodiments are briefly introduced as follows. It should be noted that the drawings described as follows are merely part of the embodiments of the present disclosure, other drawings can also be acquired by those skilled in the art without paying creative efforts.

DESCRIPTION OF EMBODIMENTS

For better illustrating technical solutions of the present disclosure, embodiments of the present disclosure will be described in detail as follows with reference to the accompanying drawings.

It should be noted that, the described embodiments are merely exemplary embodiments of the present disclosure, which shall not be interpreted as providing limitations to the present disclosure. All other embodiments obtained by those skilled in the art without creative efforts according to the embodiments of the present disclosure are within the scope of the present disclosure.

The terms used in the embodiments of the present disclosure are merely for the purpose of describing particular embodiments but not intended to limit the present disclosure. Unless otherwise noted in the context, the singular form expressions "a", "an", "the" and "said" used in the embodiments and appended claims of the present disclosure are also intended to represent plural form expressions thereof.

It should be understood that the term "and/or" used herein is merely an association relationship describing associated objects, indicating that there may be three relationships, for example, A and/or B may indicate that three cases, i.e., A existing individually, A and B existing simultaneously, B existing individually. In addition, the character "/" herein generally indicates that the related objects before and after the character form an "or" relationship.

Figure 1:
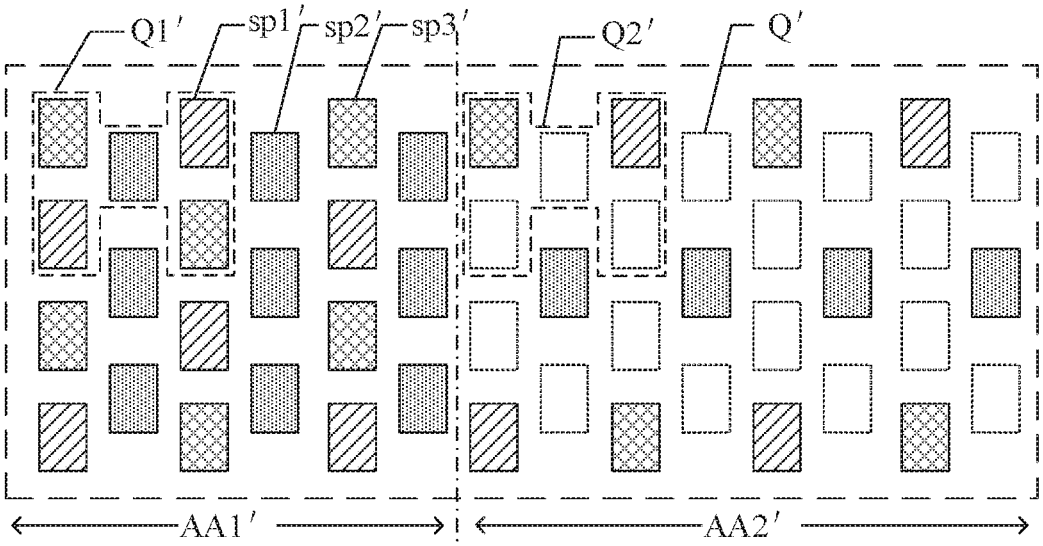
FIG. 1 (Prior Art)
FIG. 1 is a schematic diagram of a portion of a display panel according to an implementation in the related art.

For a display panel using an under-screen optical element, in general, in order to increase an amount of light received by the optical element and improve its optical performances, a sub-pixel density of a display area corresponding to the optical element is reduced to increase light transmittance of this area. FIG. 1 is a schematic diagram of a portion of a display panel according to an implementation in the related art. As shown in FIG. 1, the display area has a first display area AA1' and a second display area AA2'. A sub-pixel density of the second display area AA2' is smaller than a sub-pixel density of the first display area AA1'. During display, a driving chip writes a data signal to each sub-pixel in the display area through a data line in the display panel, so as to control the sub-pixel to emit light. The sub-pixels in the display area include sub-pixels of at least three different colors, which in the figure are respectively illustrated as a sub-pixel sp1', a sub-pixel sp2', and a sub-pixel sp3'. The sub-pixels of three colors include a sub-pixel configured to emit red light, a sub-pixel configured to emit green light, and a sub-pixel configured to emit blue light. By cooperation of the sub-pixels emitting light of three colors of red, green, and blue, the display panel achieves color display. As shown in FIG. 1, in the second display area AA2', the sub-pixel density of the second display area AA2' is reduced by providing no sub-pixel in an area Q' (an area represented by dashed lines). That is, the sub-pixel density mentioned here refers to an arrangement density of sub-pixels in an actual structure of the display panel.

In the related art, considering an influence of a manufacturing process of the display panel, a certain spacing must be kept between two adjacent sub-pixels in the display panel, and resolution of the display panel is limited. In order to further improve a display effect of the display panel, a Sub-Pixel Rendering (SPR) is used to control the display panel to perform display. By making adjacent pixels share some sub-pixels, a sensory resolution is improved without changing the arrangement density of sub-pixels. The inventor believes that in the related art, when display is performed in an entirety of the display area using the SPR manner, a problem of display color shift will occur in the second display area AA2', thereby affecting the display effect. Taking one SPR manner as an example, as shown in FIG. 1, during display, in the area Q1', a total of five sub-pixels including two sub-pixels sp1', two sub-pixels sp3' and one sub-pixel sp2' constitute one-pixel unit. In this case, when the driving chip controls the display panel to perform display, data signals are inputted to the five sub-pixels, so that the pixel unit displays different colors. Correspondingly, the conventional technical means adopted by those skilled in the art lies in that the same display method is adopted in the second display area AA2' and the first display area AA1'. Assuming that the sub-pixel density of the second display area AA2' is not adjusted, then the sub-pixels in the area Q2' should also constitute a pixel unit for displaying, and data signals are inputted to the sub-pixels in the area Q2' so that this pixel unit displays different colors. However, at present, there are actually only one sub-pixel sp3' and one sub-pixel sp1' in the area Q2'. When a color that can be displayed by superimposing and cooperation of two sub-pixels sp1', one sub-pixel sp2' and two sub-pixels sp3' need to be displayed, only a color that is formed by superimposing of one sub-pixel sp3' and one sub-pixel sp1' can be displayed. After the driving chip has undergone a sub-pixel rendering operation, it will assign to the area Q2' two data signals corresponding to two sub-pixels sp1', one data signal corresponding to one sub-pixel sp2', and two data signals corresponding to two sub-pixels sp3'. However, in the area Q2', only one sub-pixel sp1' and one sub-pixel sp3' can receive the corresponding data signals, which will cause some data signals to be lost during display in the area Q2', and only a color that is formed by superimposing of one sub-pixel sp1' and one sub-pixel sp3' can be displayed. As a result, a problem of color shift will occur in the second display area AA2', thereby affecting the display effect.

Figure 2:
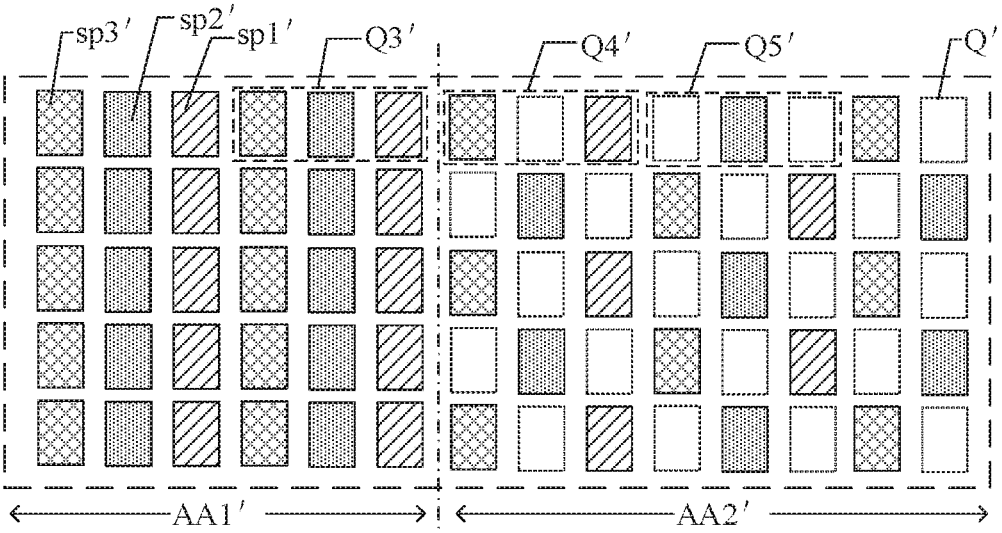
FIG. 2 (Prior Art)
FIG. 2 is a schematic diagram of a portion of a display panel according to another implementation in the related art.

FIG. 2 is a schematic diagram of a portion of a display panel according to another implementation in the related art. In the related art, as shown in FIG. 2, the sub-pixel density of the second display area AA2' is smaller than the sub-pixel density of the first display area AA1'. When the display panel as shown in FIG. 2 performs display not in a sub-pixel rendering, a conventional technical means adopted by those skilled in the art lies that after the same data processing method is applied to original image data corresponding to the first display area AA1' and the second display area AA2', data signals are respectively input to the first display area AA1' and the second display area AA2'. As shown in FIG. 2, in an area Q3' in the first display area AA1', the sub-pixel sp1', the sub-pixel sp2', and the sub-pixel sp3' constitute a pixel unit to achieve that the pixel unit displays different colors. In the area Q4' in the second display area AA2', the sub-pixel sp2 'is removed, and when the driving chip provides a data signal to the second display area AA2', a data signal will still be assigned to the sub-pixel sp2' in this area while no corresponding sub-pixel sp2' receives this data signal, which results in that the area Q4' will lack a color that should be displayed by the sub-pixel sp2' during display, leading to the problem of color shift. Similarly, only a color corresponding to the sub-pixel sp2' is displayed in an area Q5', leading to the problem of color shift.

Based on the problem existing in the related art, the embodiments of the present disclosure provide a display method of a display panel, a display panel, and a display device. When a sub-pixel density of a first display area is different from a sub-pixel density of a second display area (an area corresponding to the optical element in the display device), the first display area and the second display area respectively use different display algorithms for displaying, and meanwhile, during display, a number of data signals provided to the first display area is the same as a number of first sub-pixels, and a number of data signals provided to the second display area is the same as a number of second sub-pixels. After the display algorithm is applied, no matter whether pixel sharing is applied to display in the first display area and the second display area, the data signals corresponding to sub-pixels of different colors of each pixel unit constituting the displayed image during display are complete, thereby avoiding the problem of display color shift of the pixel unit and thus improving the display effect.

Figure 3:
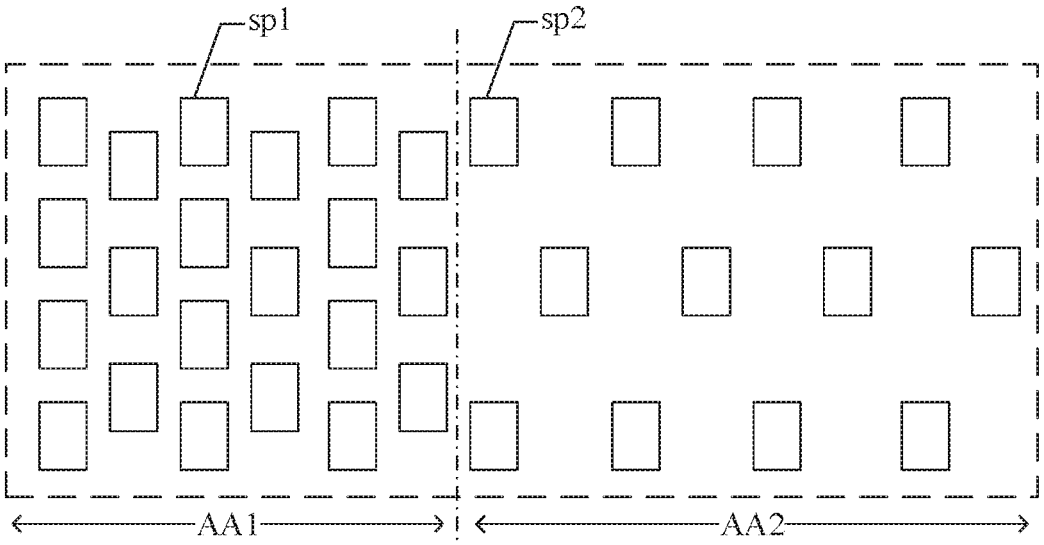
FIG. 3 is a schematic diagram of a portion of a display panel for displaying in a display manner according to an embodiment of the present disclosure.

An embodiment of the present disclosure provides a display method of a display panel. FIG. 3 is a schematic diagram of a portion of a display panel for displaying in a display manner according to an embodiment of the present disclosure. As shown in FIG. 3, the display area of the display panel has a first display area AA1 and a second display area AA2. Sub-pixels in the display area include a first sub-pixel 1*sp* and a second sub-pixel 2*sp*. The first sub-pixel 1*sp* is located in the first display area AA1 and the second sub-pixel 2*sp* is located in the second display area AA2. A sub-pixel density of the second display area AA2 is smaller than a sub-pixel density of the first display area AA1. Here, the sub-pixel density refers to a number of pixels per inch of the screen. As shown in the FIG. 2, the density of the second sub-pixels 2*sp* arranged in the second display area AA2 is smaller than the density of the first sub-pixels 1*sp* arranged in the first display area AA1. In this embodiment of the present disclosure, the sub-pixel density of the first display area or the sub-pixel density of the second display area refers to an arrangement density of sub-pixels in an actual structure of the display panel. After the sub-pixel density of the second display area AA2 is decreased, light transmittance of the second display area AA2 can be increased. When the display panel is assembled into a display device, an optical element can be provided at a position corresponding to the second display area AA2 to allow the optical element to receive sufficient light when being activated. Here, the optical element can be an optical sensor, a camera, or the like. The display panel further includes a pixel circuit (not shown in the figure), and the pixel circuit is electrically connected to the sub-pixel to drive the sub-pixel to perform display. In FIG. 3, the respective sub-pixel arrangement manners of the first display area AA1 and the second display area AA2 are merely illustrative. In practice, in order to cooperate with the particular sub-pixel rendering for displaying, the arrangement of sub-pixels of the display panel may be adjusted accordingly. It should be noted that when the display panel adopts an arrangement of sub-pixels, a sub-pixel rendering applicable thereto is not unique.

The display method provided by this embodiment of the present disclosure includes following steps.

In displaying a frame of image, different display algorithms are used in the first display area AA1 and the second display area AA2 to perform display, and a sub-pixel rendering is applied in at least one of the first display area AA1 and the second display area AA2 to perform display. Here, the number of data signals provided to the first display area AA1 is the same as the number of first sub-pixels 1*sp*, and the number of data signals provided to the second display area AA2 is the same as the number of second sub-pixels 2*sp*. When the pixel circuit drives the sub-pixels to perform display, a voltage signal written by a data line into the pixel circuit is determined as a data signal.

In an example, the sub-pixel rendering is used to perform display in the first display area AA1, and the sub-pixel rendering is not used to perform display in the second display area AA2. As another example, the sub-pixel rendering is used to perform display in the first display area AA1, and the sub-pixel rendering is also used to perform display in the second display area AA2. As a further example, the sub-pixel rendering is not used to perform display in the first display area AA1, and the sub-pixel rendering is used to perform display in the second display area AA2. Implementation manners will be described in following embodiments.

A difference between using the sub-pixel rendering and not using the sub-pixel rendering to perform display will be described as follows. When performing display in the sub-pixel rendering, one sub-pixel may be shared two or more times by other sub-pixels to constitute pixel units, and the pixel unit mentioned here is a pixel unit in a picture of the displayed image and is not a pixel formed by dividing an actual pixel arrangement of the display panel. In this case, a number of pixel units in the displayed image is larger than a number of pixels formed by actually dividing the display panel. When performing display not in the sub-pixel rendering, the number of pixel units in the displayed image is the same as the number of pixels formed by actually dividing the display panel, that is, during display, one sub-pixel only participates in forming one-pixel unit and is not involved in two or more pixel units at the same time.

Figure 4:
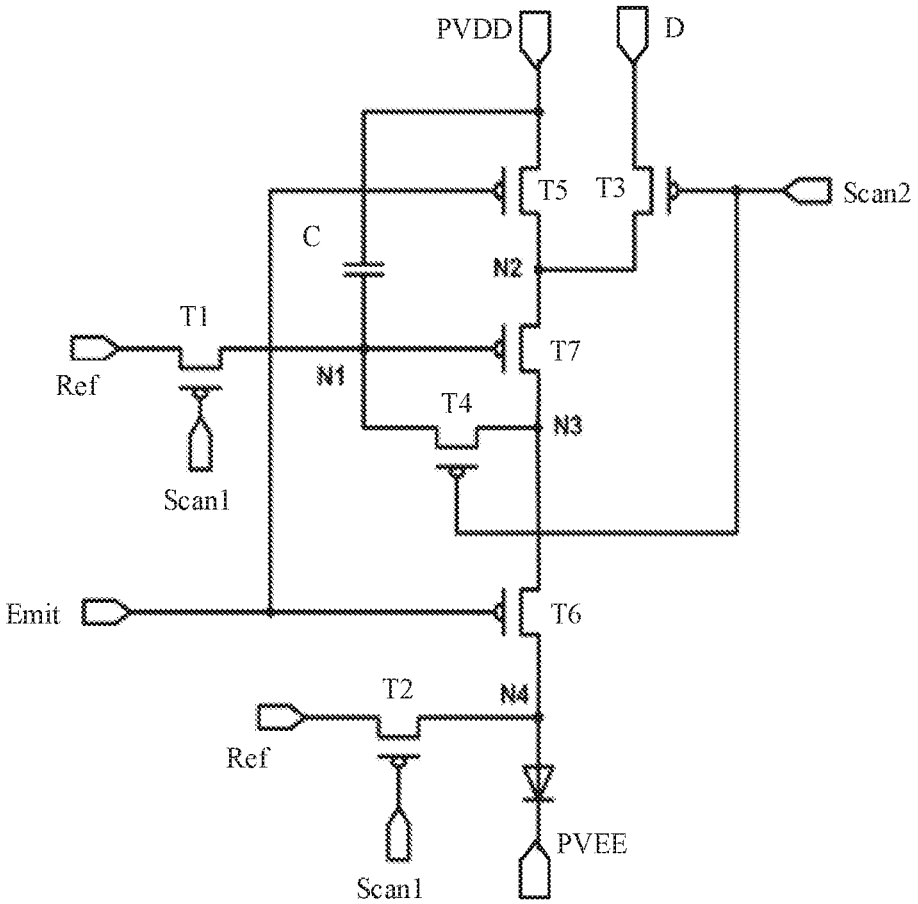
FIG. 4 is a schematic diagram of a pixel circuit used in a display method according to an embodiment of the present disclosure.

In the display method provided in this embodiment of the present disclosure, during a process in which the pixel circuit drives the sub-pixel to perform display, a voltage signal written by the data line into the pixel circuit is determined as a data signal. An explanation will be made by taking a specific pixel circuit as an example. FIG. 4 is a schematic diagram of a pixel circuit used in a display method according to an embodiment of the present disclosure, and FIG. 5 is a sequence diagram of the pixel circuit shown in FIG. 4.

As shown in FIG. 4, in an example, the pixel circuit includes seven transistors (T1 to T7) and one capacitor C. The pixel circuit includes a first scan signal terminal Scan1, a second scan signal terminal Scan2, a data signal terminal D, a positive power terminal PVDD, a negative power terminal PVEE, a reset signal terminal Ref, a light-emitting signal terminal Emit, a first node N1, a second node N2, a third node N3, and a fourth node N4. In the display panel, the data line is electrically connected to the data signal terminal D. During a phase in which the pixel circuit drives the sub-pixel to perform display, the data line inputs a data signal to the data signal terminal D.

Figure 5:
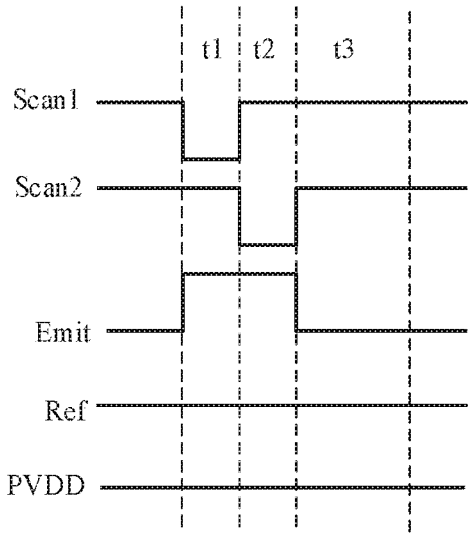
FIG. 5 is a sequence diagram of the pixel circuit shown in FIG. 4.

With reference to the sequence diagram shown in FIG. 5, operation phases of the pixel circuit can be divided into: an initialization phase t1, a data writing phase t2, and a pixel light-emitting phase t3. In the initialization phase t1, the first scan signal terminal Scan1 inputs an effective level signal, a reset signal inputted from the reset signal terminal Ref initializes the first node N1, and at the same time, the reset signal resets the fourth node N4. In the data writing stage t2, the second scan signal terminal Scan2 inputs an effective level signal, the data line inputs a data signal to the data signal terminal D, the data signal terminal D provides the data signal to the second node N2, the driving transistor T7 is turned on, and the second node N2 provides a voltage signal to the third node N3. In this phase, under control of the effective level signal, the transistor T4 provides the signal of the third node N3 to the first node N1 to perform threshold compensation on the driving transistor T7. In the pixel light-emitting phase t3, the light-emitting signal terminal Emit inputs an effective level signal, a control transistor T5 is turned on, a positive power signal inputted from the positive power terminal PVDD is provided to the second node N2, and the driving transistor T7 is maintained as being turned on for a certain period of time until it is turned off. In this phase, the second node N2 provides a voltage signal to the third node N3, the transistor T6 is turned on, and the signal of the third node N3 is provided to the fourth node N4, so that the fourth node N4 charges an anode of the light-emitting device until a lighting voltage is reached, and the light-emitting device emits light. Here, one sub-pixel includes one light-emitting device.

When the pixel circuit drives the sub-pixel to perform display, in the data writing phase, the data line provides a voltage signal to the pixel circuit, and this voltage signal is determined as a data signal. That is, in one frame of an image, one sub-pixel uses one data signal for light-emitting display. In this embodiment of the present disclosure, when displaying one frame of image, the number of data signals provided to the first display area AA1 is the same as the number of first sub-pixels 1*sp*, that is, the data signals correspond to the first sub-pixels 1*sp* in one-to-one correspondence. All of data signals inputted to the first display area AA1 are received by the first sub-pixels 1*sp*. The data signals corresponding to the first sub-pixels of different colors in the pixel units constituted by the first sub-pixels 1*sp* are complete, and there is no loss of data signals. Therefore, the pixel unit displays colors accurately and the problem of color shift in the first display area AA1 is avoided. Similarly, the number of data signals provided to the second display area AA2 is the same as the number of the second sub-pixels 2*sp*, that is, the data signals provided to the second display area AA2 correspond to the second sub-pixels 2*sp* in one-to-one correspondence. All of data signals inputted to the second display area AA2 are received by the second sub-pixel 2*sp*. The data signals corresponding to the second sub-pixels of different colors in the pixel units constituted by the second sub-pixels 2*sp* are complete, and there is no loss of data signals. Therefore, the pixel unit displays colors accurately and the problem of color shift in the second display area AA2 is avoided.

When the sub-pixel rendering is used to perform display in both the first display area and the second display area, a visual resolution of the display panel can be improved as a whole. The number of data signals provided to the first display area is the same as the number of first sub-pixels, and the number of data signals provided to the second display area is the same as the number of second sub-pixels. Since the sub-pixel density of the first display area is different form the sub-pixel density of the second display area, at this time, different sub-pixel renderings are adopted in the first display area and the second display area. In this embodiment of the present disclosure, when both the first display area and the second display area adopt a sub-pixel sharing manner to form pixel units for displaying, the data signals corresponding to sub-pixels of different colors in the pixel units in the respective displayed images are complete, and there is no loss of data signals. Therefore, display of accurate colors can be achieved in both the first display area and the second display area, thereby avoiding the problem of color shift in the related art due to the same display algorithm being adopted in the two areas for performing display.

When the sub-pixel rendering is used to perform display in the first display area and is not used in the second display area to perform display, the number of data signals provided to the first display area is the same as the number of first sub-pixels. When the sub-pixel sharing manner is used in the first display area to form pixel units for displaying, the data signals corresponding to sub-pixels of different colors in the pixel units are complete, and there is no loss of data signals. Therefore, display of accurate colors can be achieved in the first display area, thereby avoiding the problem of color shift. Meanwhile, the number of data signals provided to the second display area is the same as the number of second sub-pixels, after the original image data corresponding to the second display area is processed by the display algorithm, all of the data signals provided to the second display are can be received by the second sub-pixels, and no data signal will be aligned to a position where no sub-pixel is arranged. The data signals corresponding to sub-pixels of different colors in the pixel units of the second display area are also complete, and there is no loss of data signals. This can avoid the problem of color shift in the related art due to the same display algorithm being adopted in the first display area and the second display area for displaying.

When the sub-pixel rendering is not used to perform display in the first display area and is used in the second display area to perform display, the number of data signals provided to the first display area is the same as the number of first sub-pixels, after the original image data corresponding to the first display area is processed by the display algorithm, all of data signals provided to the first display area can be received by the first sub-pixels, the data signals corresponding to sub-pixels of different colors in the pixel units of the first display area are also complete, and there is no loss of data signals. Meanwhile, the number of data signals provided to the second display area is the same as the number of second sub-pixels, when the sub-pixel sharing manner is used in the second display area to form pixel units for displaying, the data signals corresponding to sub-pixels of different colors in the pixel units are complete, and there is no loss of data signals. In view of this, display of accurate colors can be achieved in both the first display area and the second display area, thereby avoiding the problem of color shift in the related art due to the same display algorithm being adopted in the first display area and the second display area for displaying. Moreover, since the sub-pixel density of the second display area is smaller than the sub-pixel density of the first display area, a resolution of the second display area is smaller than that of the first display area. The sub-pixel rendering is not used to perform display in the first display area and is used in the second display area to perform display, so that the visual resolution of the second display area can be improved, thereby reducing a difference in visual resolution between the first display area and the second display area and thus improving the display effect.

In the display method provided by this embodiment of the present disclosure, different display algorithms are adopted in the first display area and the second display area with different sub-pixel densities for displaying, and the sub-pixel rendering is used to perform display in at least one display area. After the original image data corresponding to each of the first display area and the second display area is processed by the corresponding display algorithm, the number of data signals provided to the first display area is the same as the number of first sub-pixels, and the number of data signals provided to the second display area is the same as the number of second sub-pixels, so that the data signals corresponding to sub-pixels of different colors in the pixel units in an image displayed by the first display area and an image displayed by the second display area are complete, and there is no loss of data signals. This can avoid the problem of color shift in the related art due to the same display algorithm being adopted in the first display area and the second display area.

Figure 6:
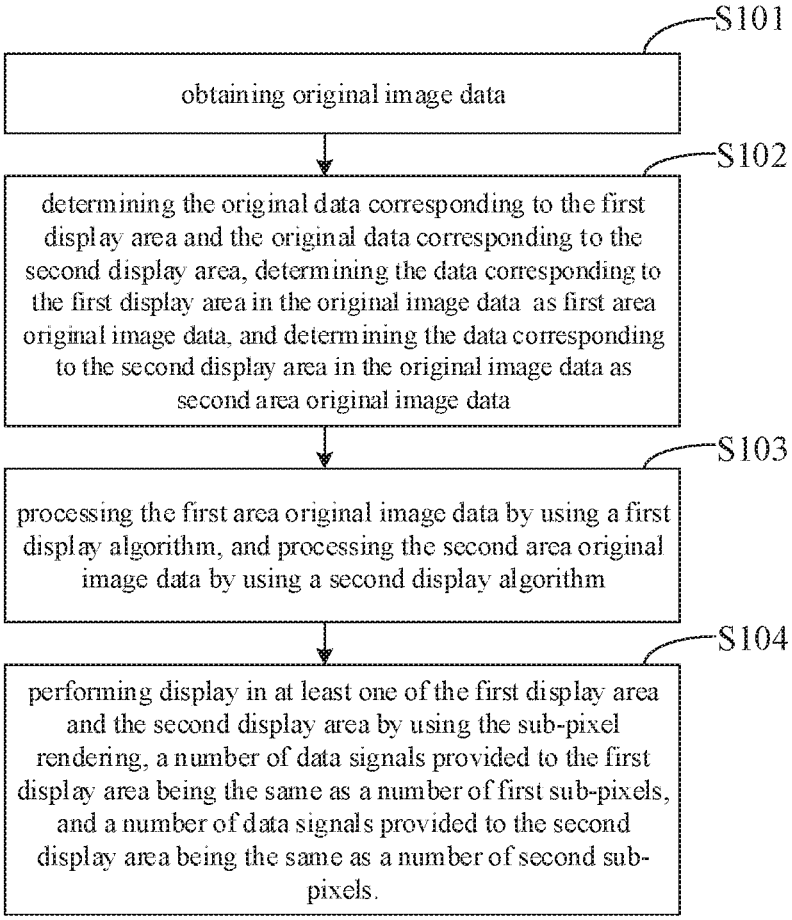
FIG. 6 is a flowchart of a display method according to an embodiment of the present disclosure.

FIG. 6 is a flowchart of a display method according to an embodiment of the present disclosure. As shown in FIG. 6, when the display panel is controlled to perform display by using the display method provided by this embodiment of the present disclosure, the display process includes following steps.

At step S101, original image data is obtained. Here, an original image is constituted by multiple pixels, so the original image data includes data information corresponding to each pixel unit in the original image. After the original image data is processed by a display algorithm, a data signal can be outputted to the display area accordingly, so that the display panel can display an image. For the display method in which different display algorithms are used in the first display area and the second display area for displaying, when processing the original image, first it needs to be divided into original data corresponding to the first display area and original data corresponding to the second display area, then in a subsequent data processing, the original data is processed by using respective display algorithms.

At step S102, the original data corresponding to the first display area and the original data corresponding to the second display area are determined. The data corresponding to the first display area in the original image data is determined as first area original image data, and the data corresponding to the second display area in the original image data is determined as second area original image data.

At step S103, the first area original image data is processed by using a first display algorithm, and the second area original image data is processed by using a second display algorithm. After the original image is processed, different display algorithms are used in the first display area and the second display area to perform display. Therefore, there are different corresponding processing processes for the original image data of the first display area and the second display area. After calculation in this step, the sub-pixel rendering is used in both the first display area and the second display area to perform display; or, the sub-pixel rendering is used in the first display area to perform display and is not used in the second display area to perform display; or, the sub-pixel rendering is not used in first display area to perform display but used in the second display area to perform display. Different data processing processes corresponding to different display manners will be described in following embodiments.

At step S104, the sub-pixel rendering is used in at least one of the first display area and the second display area to perform display. After the first area original image data and the second area original image data are respectively processed by using different display algorithms, a number of data signals provided to the first display area is the same as a number of first sub-pixels and a number of data signals provided to the second display area is the same as a number of second sub-pixels. The data signals corresponding to sub-pixels of different colors in the pixel units in the image displayed by the first display area and the image displayed by the second display area are complete, and there is no loss of data signals, thereby avoiding the problem of display color shift. Further, an embodiment of the present disclosure provides an implementation for determining original data corresponding to the first display area and original data corresponding to the second display area.

Figure 7:
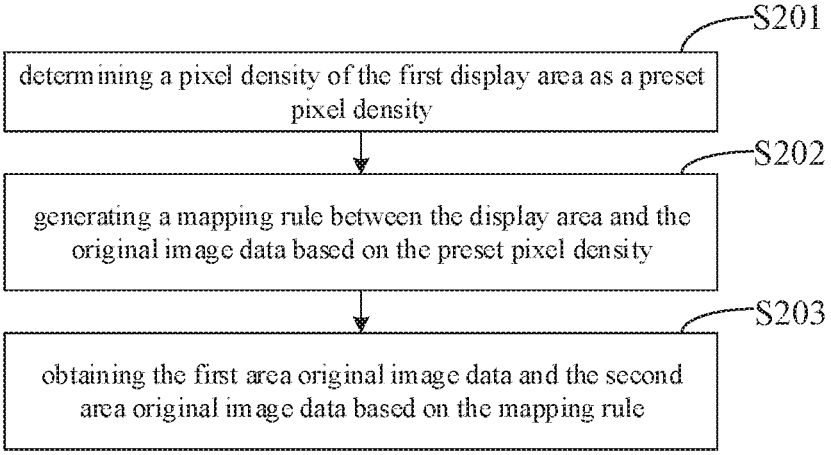
FIG. 7 is a flowchart of a display method according to another embodiment of the present disclosure.

FIG. 7 is a flowchart of a display method according to another embodiment of the present disclosure. As shown in FIG. 7, determining the original data corresponding to the first display area and the original data corresponding to the second display area includes following steps.

At step S201, a sub-pixel density of the first display area is determined as a preset sub-pixel density. The sub-pixel density of the first display area is larger than the sub-pixel density of the second display area. Generally, when an under-screen optical element scheme is adopted, a display area corresponding to the under-screen optical element occupies a small area in the overall display area, that is, a total area of the first display area is larger than a total area of the second display area. Thus, the sub-pixel density of the first display area is set to be the preset sub-pixel density, and a correspondence between the display area and the original image data is calculated by taking the sub-pixel density of the first display area as a standard.

At step S202, a mapping rule between the display area and the original image data is generated based on the preset sub-pixel density. Here, one frame of image displayed on the display panel corresponds to an original image, and the original image itself also has a sub-pixel density. For a display panel that performs display not in the sub-pixel rendering, the sub-pixel density of the original image corresponding to one frame of image is the same as the sub-pixel density of the actual arrangement in the display area. For a display panel that uses the sub-pixel rendering for display, the sub-pixel density of the original image corresponding to one frame of image is larger than the sub-pixel density of the actual arrangement in the display area, thereby achieving improvement in the visual resolution.

With the display method provided by this embodiment of the present disclosure, the sub-pixel density of the first display area that is larger is determined as the preset sub-pixel density, and a mapping rule between the display area and the original image data can be generated based on a relationship between the preset sub-pixel density and the sub-pixel density of the original image itself.

At step S203, the first area original image data and the second area original image data are obtained based on the mapping rule, that is, the original image data can be divided into original image data corresponding to the first display area and original image data corresponding to the second display area based on the mapping rule.

In an example, a principle of the display method in the embodiment of FIG. 7 will be described. Assuming that when designing a pixel arrangement of the overall display area of the display panel according to the preset sub-pixel density, 2160*1080*2 sub-pixels can be manufactured in the display area, and the original image data includes 2160*1080*3 data signals (i.e., corresponding to 2160*1080*3 sub-pixels). The preset sub-pixel density is m1, and the sub-pixel density of the original image is m2, where m1:m2=2:3. That is, a display area with a preset sub-pixel density of m1 is used to display the original image with a sub-pixel density of m2. In one rule, it is assumed that a size of one pixel in the original image is the same as a size of one pixel in the display area, and a ratio of an area S1 of the overall display area to an area S2 of the original image is S1:S2=2:3. The original image is scaled to coincide with the overall display area according to this ratio. After scaling, a first part of the original image corresponds to the first display area, and a second part of the image corresponds to the second display area. Then the first part of the scaled original image corresponds to the first area original image data, and the second part of the scaled original image corresponds to the second area original image data. As a result, original image data corresponding to the first display area and original image data corresponding to the second display area are obtained.

In an actual display panel, positions of the first display area and the second display area relative to the overall display area (i.e., the display area) are unchanged, that is, there is a first positional relationship between the first display area and the display area, and there is a second positional relationship between the second display area and the display area. In another embodiment, after a mapping relationship between the display area and the original image data is generated, the first area original image data is determined in the original image data based on the first positional relationship, and the second area original image data is determined in the original image data based on the second positional relationship.

Figure 8:
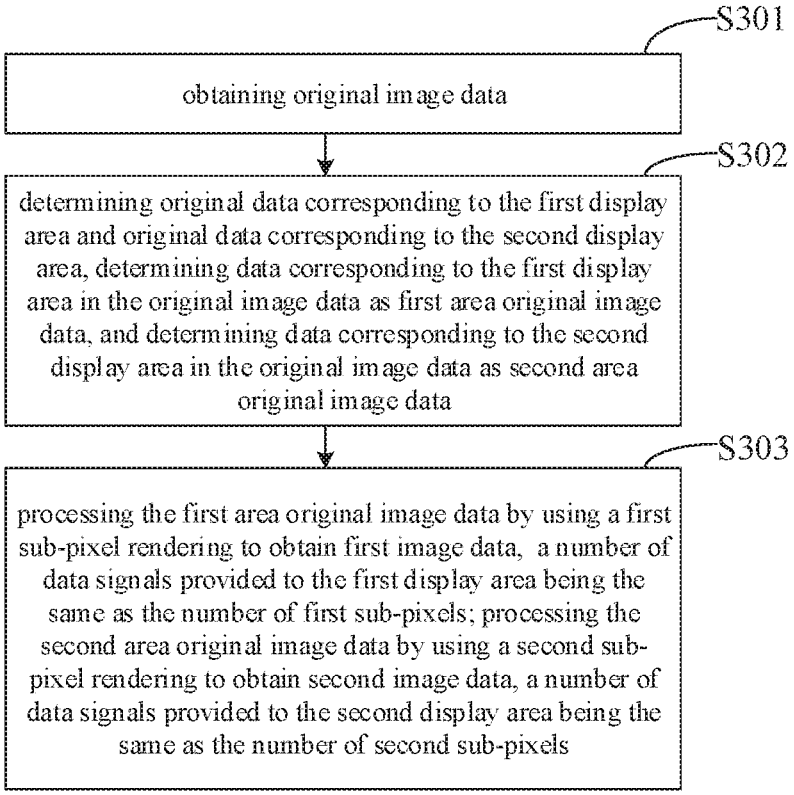
FIG. 8 is a flowchart of a display method according to another embodiment of the present disclosure.

In some implementations, in the display method provided by this embodiment of the present disclosure, the sub-pixel rendering are adopted in both the first display area and the second display area to perform display. FIG. 8 is a flowchart of a display method according to another embodiment of the present disclosure. As shown in FIG. 8, the display method includes following steps.

At step S301, original image data is obtained.

At step S302, original data corresponding to the first display area and original data corresponding to the second display area are determined. Data corresponding to the first display area in the original image data is determined as first area original image data, and data corresponding to the second display area in the original image data is determined as second area original image data.

At step S303, the first area original image data is processed by using a first sub-pixel rendering to obtain first image data, if a number of data signals in the first image data is the same as a number of first sub-pixels, a number of data signals provided to the first display area is the same as the number of first sub-pixels; the second area original image data is processed by using a second sub-pixel rendering to obtain second image data, if a number of data signals in the second image data is the same as a number of second sub-pixels, a number of data signals provided to the second display area is the same as the number of second sub-pixels.

Figure 9:
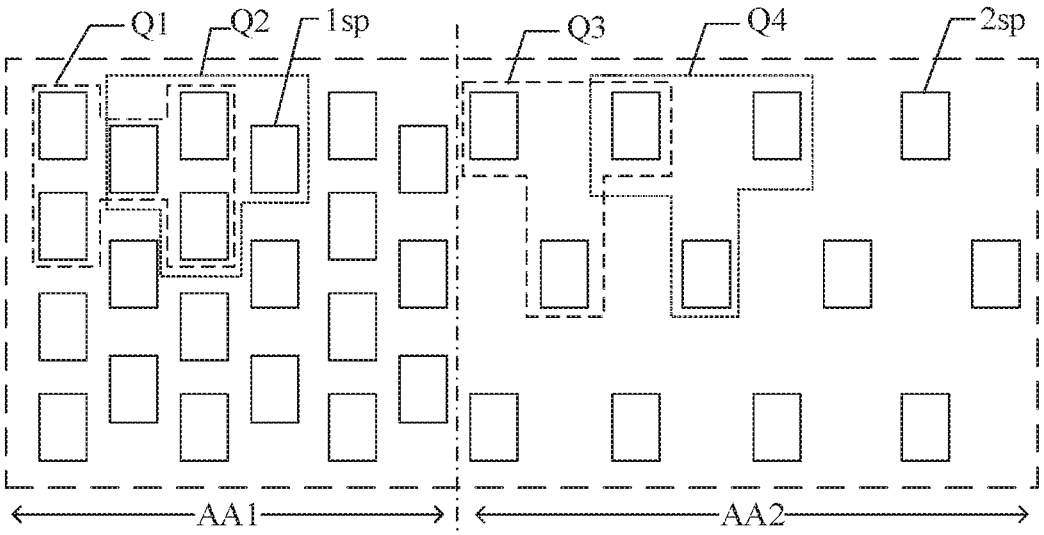
FIG. 9 is a schematic diagram of a display panel for displaying by using the display method in the embodiment of FIG. 8.

In the display method provided by this embodiment, display is performed in the first display area by using the first sub-pixel rendering, and display is performed in the second display area by using the second sub-pixel rendering. FIG. 9 is a schematic diagram of a display panel for displaying by using the display method in the embodiment of FIG. 8. As shown in FIG. 9, an arrangement density of second sub-pixels 2*sp* in the second display area AA2 is smaller than an arrangement density of first sub-pixels 1*sp* in the first display area AA1. After the original image data corresponding to the first display area AA1 is processed, display is performed in the first display area AA1 by using the first sub-pixel rendering. As shown in the figure, during display, five first sub-pixels 1*sp* in the area Q1 constitute one-pixel unit, and four first sub-pixels 1*sp* in the area Q2 constitute one-pixel unit. These two-pixel units are adjacent to each other and share three first sub-pixels 1*sp*. After the original image data corresponding to the second display area AA2 is processed, display is performed in the second display area AA2 by using the second sub-pixel rendering. As shown in the figure, during display, three second sub-pixels 2*sp* in the area Q3 constitute one-pixel unit, and three second sub-pixels 2*sp* in the area Q4 constitute one-pixel unit. These two-pixel units are adjacent to each other and share one second sub-pixel 2*sp*. Different sub-pixel renderings are used to perform display in the first display area and the second display area, which can improve the visual resolution of the display panel as a whole. The number of data signals provided to the first display area is the same as the number of first sub-pixels, and the number of data signals provided to the second display area is the same as the number of second sub-pixels. When the sub-pixel sharing manner is used in both the first display area and the second display area to form pixel units for display, the data signals corresponding to sub-pixels of different colors in the pixel units in the respective displayed images are complete, and there is no loss of data signals. Therefore, display of accurate colors can be achieved in both the first display area and the second display area, thereby avoiding the problem of color shift in the related art due to the same display algorithm being adopted in the two areas for performing display.

Figure 10:
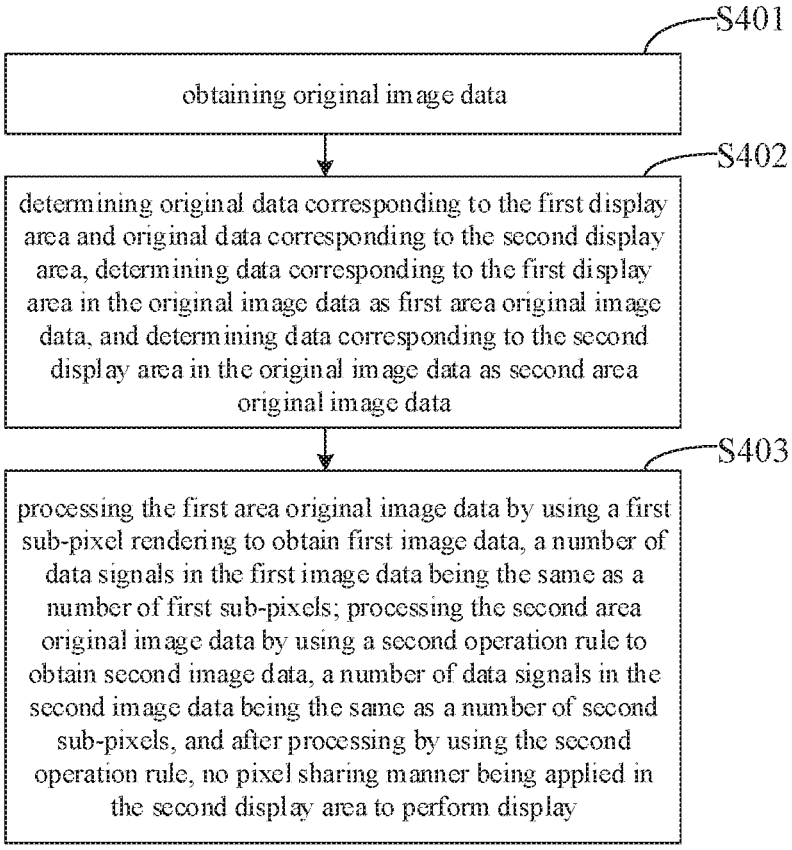
FIG. 10 is a flowchart of a display method according to another embodiment of the present disclosure.

In some implementations, in the display method provided by this embodiment of the present disclosure, the sub-pixel rendering is used to perform display in the first display area, and is not used to perform display in the second display area. FIG. 10 is a flowchart of a display method according to another embodiment of the present disclosure. As shown in FIG. 10, the display method includes following steps.

At step S401, original image data is obtained.

At step S402, original data corresponding to the first display area and original data corresponding to the second display area are determined, data corresponding to the first display area in the original image data is determined as first area original image data, and data corresponding to the second display area in the original image data is determined as second area original image data.

At step S403, the first area original image data is processed by using a first sub-pixel rendering to obtain first image data, and a number of data signals in the first image data is the same as a number of first sub-pixels; the second area original image data is processed by using a second operation rule to obtain second image data, and a number of data signals in the second image data is the same as a number of second sub-pixels, and after processing by using the second operation rule, no pixel sharing manner is applied in the second display area to perform display.

Figure 11:
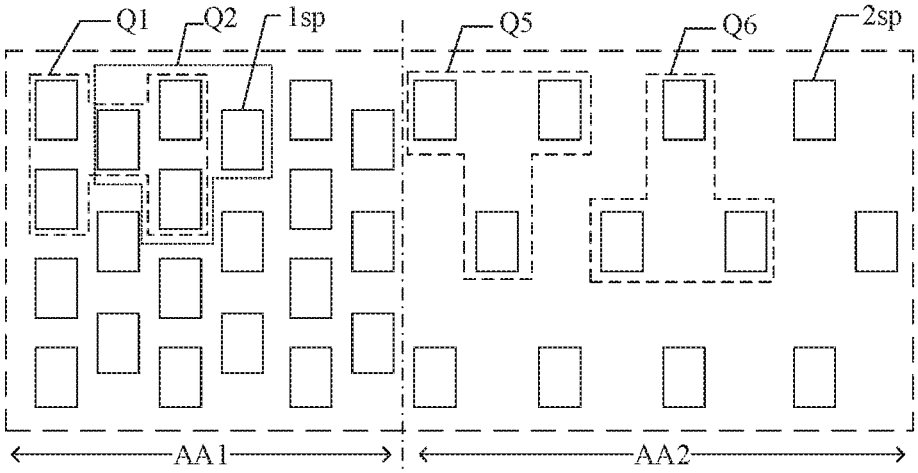
FIG. 11 is a schematic diagram of a display panel for displaying by using the display method in the embodiment of FIG. 10.

In the display method provided by this embodiment, the first sub-pixel rendering is used to perform display in the first display area, and no sub-pixel rendering is used to perform display in the second display area. FIG. 11 is a schematic diagram of a display panel for displaying by using the display method in the embodiment of FIG. 10. As shown in FIG. 11, an arrangement density of second sub-pixels 2*sp* in the second display area AA2 is smaller than an arrangement density of first sub-pixels 1*sp* in the first display area AA1. After the original image data corresponding to the first display area AA1 (the first area original image data) is processed, the first sub-pixel rendering is used to perform display in the first display area AA1. As shown in the figure, during display, five first sub-pixels 1*sp* in the area Q1 constitute one-pixel unit, and four first sub-pixels 1*sp* in the area Q2 constitute one-pixel unit. These two-pixel units are adjacent to each other and share three first sub-pixels 1*sp*. After the original image data corresponding to the second display area AA2 is processed by using the second operation rule, no sub-pixel rendering is used to perform display in the second display area AA2. As shown in the figure, during display, three second sub-pixels 2*sp* in the area Q5 constitute one-pixel unit, and three second sub-pixels 2*sp* in the area Q6 constitute one-pixel unit. These two-pixel units are adjacent to each other and share no second sub-pixel 2*sp*. Alternatively, in another implementation, after the original image data corresponding to the second display area is processed by using the second operation rule, that is, after the original image data is averaged or weighted such that all data in the original image data are involved in the operation, data signals are provided to the second display area, and a number of data signals provided to the second display area is the same as a number of second sub-pixels. Then after the original image data corresponding to the second display area is processed by using a display algorithm, all data signals further provided to the second display area can be received by the second sub-pixels, and no data signal will be aligned to a position where no sub-pixel is arranged. The data signals corresponding to sub-pixels of different colors in the pixel units of the second display area are complete, and there is no loss of data signals. This can avoid the problem of color shift in the related art due to the same display algorithm being adopted in the first display area and the second display area for displaying.

When no sub-pixel rendering is applied in the second display area to perform display, multiple data processing methods may be used to process the second original image data corresponding to the second display area, and some optional processing methods will be described in following embodiments.

Figure 12:
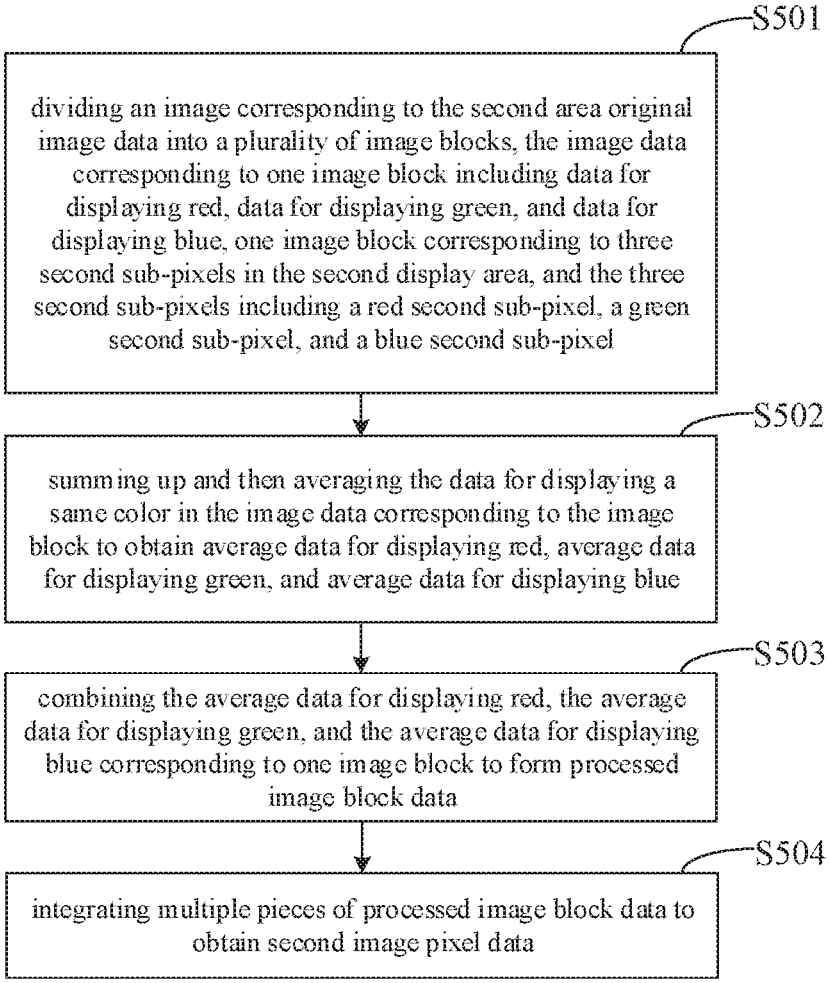
FIG. 12 is a flowchart of an implementation of processing second area original image data by using a display method according to an embodiment of the present disclosure.
Figure 13:
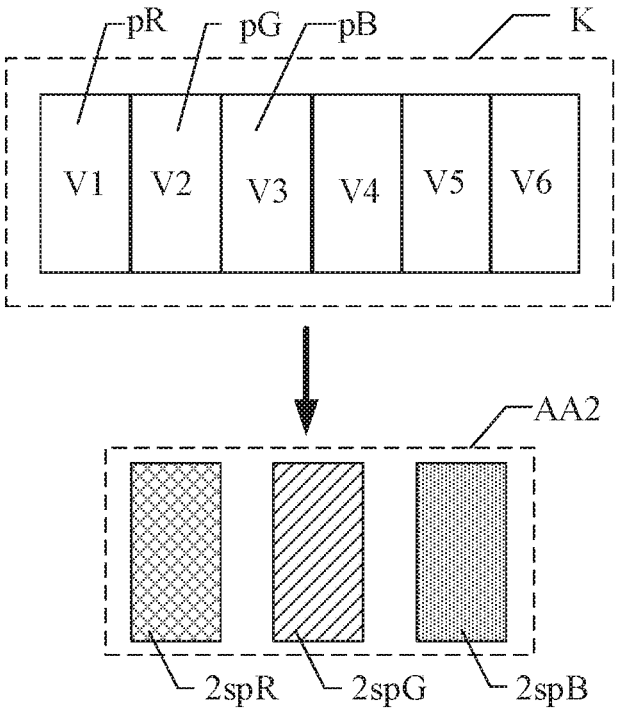
FIG. 13 is a schematic diagram illustrating a principle of the display method corresponding to the embodiment of FIG. 12.

FIG. 12 is a flowchart of an implementation of processing second area original image data by using a display method according to an embodiment of the present disclosure, and FIG. 13 is a schematic diagram illustrating a principle of the display method corresponding to the embodiment of FIG. 12. A division manner of image blocks shown in FIG. 13 is merely for illustrating an implementation principle of an embodiment of the present disclosure and is not intended to limit the present disclosure. With reference to FIG. 12 and FIG. 13, the second area original image data being processed by using the second operation rule includes following steps.

At step S501, an image corresponding to the second area original image data is divided into a plurality of image blocks. The image data corresponding to one image block includes data for displaying red, data for displaying green, and data for displaying blue. One image block corresponds to three second sub-pixels in the second display area, and the three second sub-pixels include a red second sub-pixel, a green second sub-pixel, and a blue second sub-pixel.

According to the correspondence between the second area original image data and the second display area, after the image corresponding to the second area original image data is divided into a plurality of image blocks, each image block corresponds to three second sub-pixels in the second display area, and the second sub-pixels corresponding to each image block have different positions in the second display area. Since the sub-pixel density of the original image (the image corresponding to the original image data) is larger than an actual sub-pixel density of the display panel, after the original image is divided, one image block includes more than three sub-pixels.

As shown in FIG. 13, in an example, one image block K includes 6 sub-pixels, that is, the image data corresponding to this image block includes data information respectively corresponding to the 6 sub-pixels. After being processed by using the second operation rule, the second sub-pixels 2*sp* of three different colors in the second display area will display the image data of the six sub-pixels.

At step S502, the data for displaying a same color in the image data corresponding to the image block is summed up and then averaged to obtain average data for displaying red, average data for displaying green, and average data for displaying blue. As shown in FIG. 13, the 6 sub-pixels corresponding to one image block K include a red sub-pixel pR, a green sub-pixel pG, and a blue sub-pixel pB. Here, data signals (optionally voltage values) corresponding to respective sub-pixels in the image block K are all marked in the figure. The image block K corresponds to one red second sub-pixel 2*sp*R, one green second sub-pixel 2*sp*G, and one blue second sub-pixel 2*sp*B. Then, an average value of the data for displaying a same color is obtained by calculation: an average data for displaying red is (V1+V4)/2, which during display is correspondingly provided to the red second sub-pixel 2*sp*R in the figure; the average data for displaying green is (V2+V5)/2, which during display is correspondingly provided to the green second sub-pixel 2*sp*G in the figure; and the average data for displaying blue is (V3+V6)/2, which during display is correspondingly provided to the blue second sub-pixel 2*sp*B in the figure.

At step S503, the average data for displaying red, the average data for displaying green, and the average data for displaying blue corresponding to one image block are combined to form processed image block data. Taking the correspondence between the image block and the second display area shown in FIG. 13 as an example, the processed image block data includes: average data (V1+V4)/2 for displaying red, average data (V2+V5)/2 for displaying green, and average data (V3+V6)/2 for displaying blue.

At step S504, multiple pieces of processed image block data are integrated to obtain second image pixel data. After the divided image blocks are processed separately, multiple pieces of processed image block data are re-integrated into new image data (i.e., the second image pixel data) according to a previous division rule. At this time, a number of data signals in the second image data is the same as a number of second sub-pixels, and after being processed by using the second operation rule, no pixel sharing manner is applied in the second display area to perform display. All of the data signals provided to the second display area can be received by the second sub-pixels, and no data signal will be aligned to a position where no sub-pixel is arranged. Therefore, the data signals corresponding to sub-pixels of different colors in the pixel units of the second display area are complete, and there is no loss of data signals, thereby avoiding the problem of color shift in the related art due to the same display algorithm being adopted in the first display area and the second display area for displaying. Moreover, in the display method provided by this embodiment, division of the image blocks is simple, and the data corresponding to the image blocks is processed merely by summing and averaging, and thus a calculation process thereof is simple.

Figure 14:
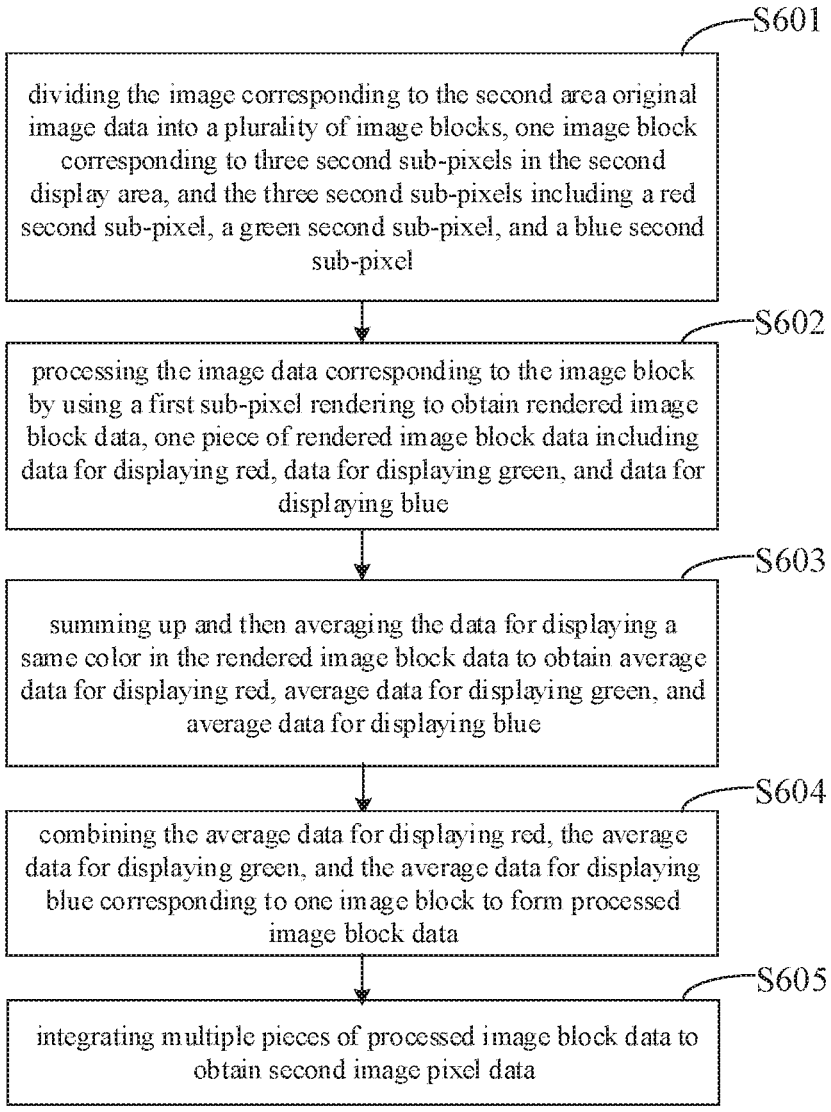
FIG. 14 is a flowchart of another implementation of processing second area original image data in a display method according to an embodiment of the present disclosure.

FIG. 14 is a flowchart of another implementation of processing second area original image data in a display method according to an embodiment of the present disclosure. As shown in FIG. 14, the second area original image data being processed by using the second operation rule to obtain the second image data includes following steps.

At step S601, the image corresponding to the second area original image data is divided into a plurality of image blocks. One image block corresponds to three second sub-pixels in the second display area, and the three second sub-pixels include a red second sub-pixel, a green second sub-pixel, and a blue second sub-pixel.

According to the correspondence between the second area original image data and the second display area, after the image corresponding to the second area original image data is divided into a plurality of image blocks, each image block corresponds to three second sub-pixels in the second display area, and the second sub-pixels corresponding to each image block have different positions in the second display area. Since the sub-pixel density of the original image (the image corresponding to the original image data) is larger than an actual sub-pixel density of the display panel, after the original image is divided, one image block corresponds to more than three sub-pixels.

At step S602, the image data corresponding to the image block is processed by using a first sub-pixel rendering to obtain rendered image block data. One piece of rendered image block data includes data for displaying red, data for displaying green, and data for displaying blue. In the display panel, the sub-pixel density of the first display area is larger than the sub-pixel density of the second display area. A first sub-pixel rendering is used to perform display in the first display area, indicating that the sub-pixel density of the original image that the display panel needs to display is larger than the sub-pixel density of the first display area. In this implementation, after the image corresponding to the second area original image data is divided, first the image data corresponding to the image block is processed by using the first sub-pixel rendering, that is, at this time, first the image block is processed by using the same rendering algorithm as that of the first display area. The sub-pixel density of the image corresponding to the rendered image block data obtained after processing is the same as the sub-pixel density of the first display area. Subsequently, data processing is performed on the rendered image block data.

At step S603, the data for displaying a same color in the rendered image block data is summed up and then averaged to obtain average data for displaying red, average data for displaying green, and average data for displaying blue. For the calculation method for the average data, reference may be made to the description corresponding to FIG. 13 described above, and details will not be further described herein.

At step S604, the average data for displaying red, the average data for displaying green, and the average data for displaying blue corresponding to one image block are combined to form processed image block data.

At step S605, multiple pieces of processed image block data are integrated to obtain second image pixel data.

This embodiment is applicable to a case where the sub-pixel density of the second display area is highly different from the sub-pixel density of the original image. First, the divided image blocks are processed by using the same rendering algorithm as that of the first display area, then the sub-pixel density of the image corresponding to the rendered image block data obtained after processing is the same as the sub-pixel density of the first display area. Then, the rendered image block data is processed, and the data for displaying a same color is summed up and then averaged to obtain the average data for displaying each color. Finally, multiple pieces of processed image block data are re-integrated into new image data (i.e., the second image pixel data) according to a previous division rule. At this time, a number of data signals in the second image data is the same as a number of second sub-pixels, and after being processed by using the second operation rule, no pixel sharing manner is applied in the second display area to perform display. All of the data signals provided to the second display area can be received by the second sub-pixels, and no data signal will be aligned to a position where no sub-pixel is arranged. Therefore, the data signals corresponding to sub-pixels of different colors in the pixel units of the second display area are complete, and there is no loss of data signals, thereby avoiding the problem of color shift in the related art due to the same display algorithm being adopted in the first display area and the second display area for displaying.

Figure 15:
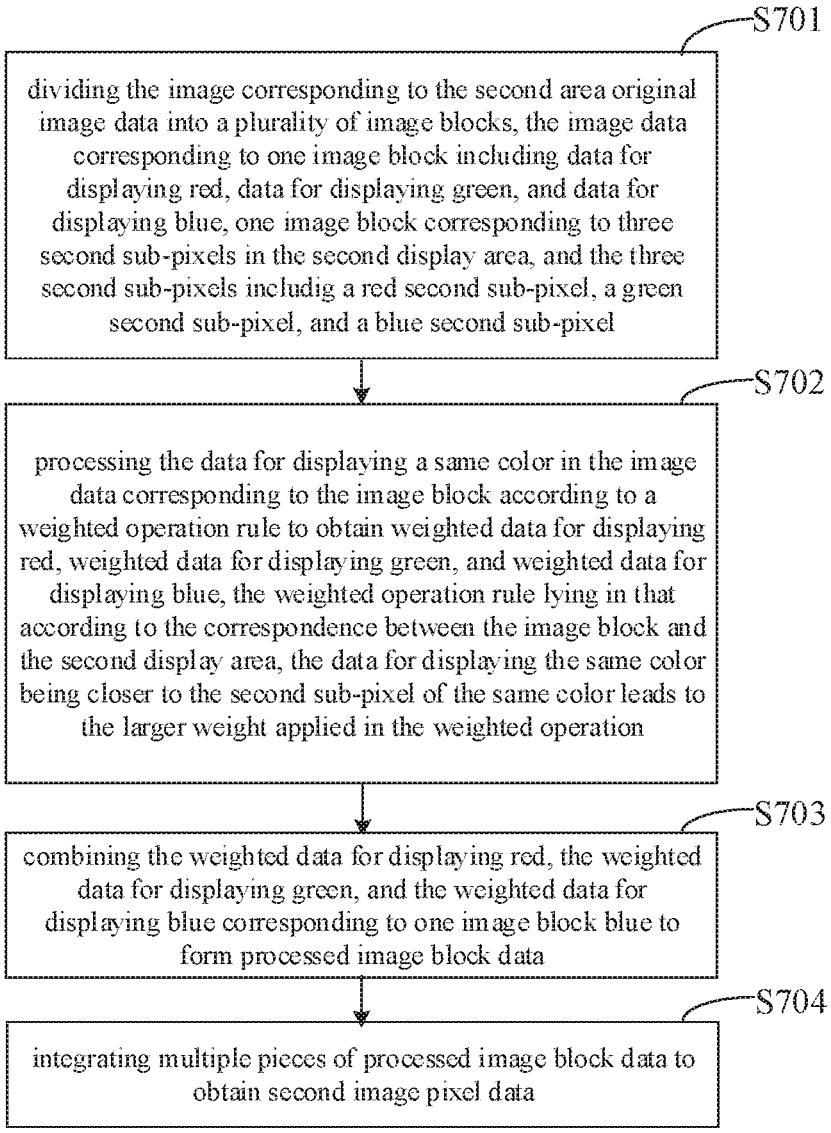
FIG. 15 is a flowchart of another implementation of processing second area original image data in a display method according to an embodiment of the present disclosure.
Figure 16:
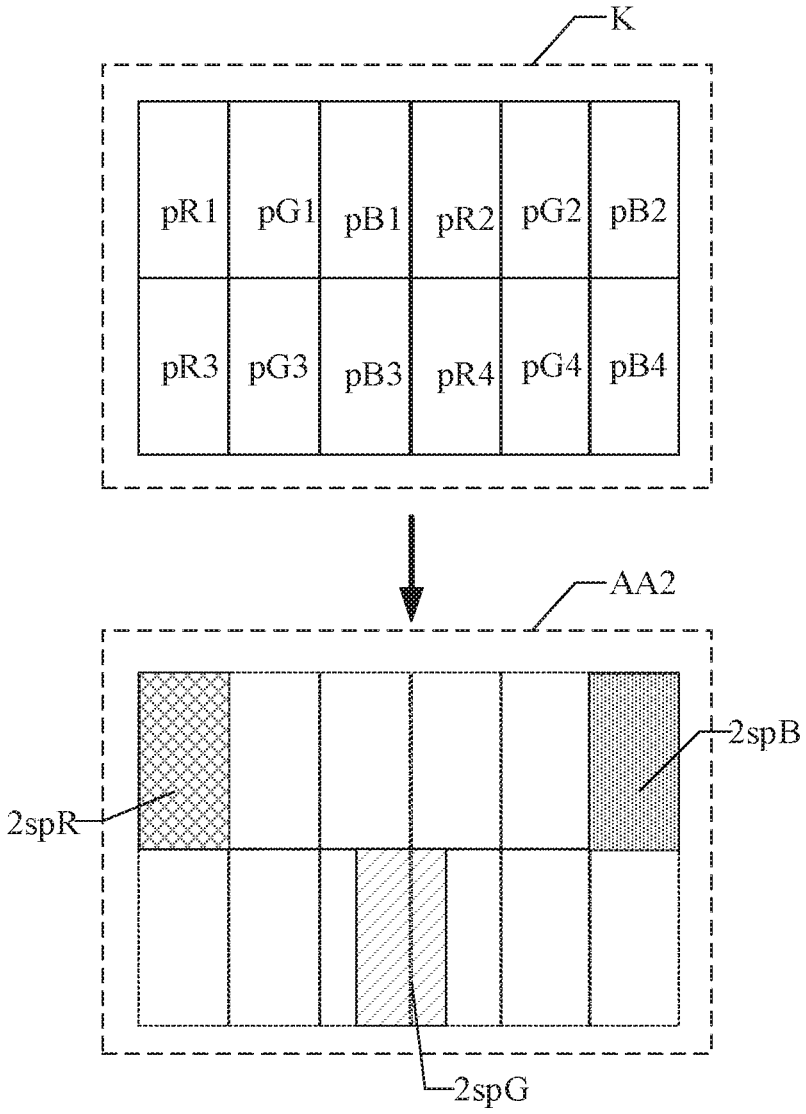
FIG. 16 is a schematic diagram of a principle of a display method corresponding to the embodiment of FIG. 15.

FIG. 15 is a flowchart of another implementation of processing second area original image data in a display method according to an embodiment of the present disclosure, and FIG. 16 is a schematic diagram of a principle of a display method corresponding to the embodiment of FIG. 15. A division manner of image blocks shown in FIG. 16 is merely for illustrating an implementation principle of an embodiment of the present disclosure and is not intended to limit the present disclosure. With reference to FIG. 15, the second area original image data being processed by using the second operation rule includes following steps.

At step S701, the image corresponding to the second area original image data is divided into a plurality of image blocks. The image data corresponding to one image block includes data for displaying red, data for displaying green, and data for displaying blue. One image block corresponds to three second sub-pixels in the second display area, and the three second sub-pixels include a red second sub-pixel, a green second sub-pixel, and a blue second sub-pixel. As shown in FIG. 16, in an example, one image block K includes 12 sub-pixels, including red sub-pixels pR1, pR2, pR3, and pR4, green sub-pixels pG1, pG2, pG3, and pG4, and blue sub-pixels pB1, pB2, pB3 and pB4. The red sub-pixels correspond to the data for displaying red, the green sub-pixels correspond to the data for displaying green, and the blue sub-pixels correspond to the data for displaying blue. The second sub-pixels in the second display area corresponding to the image block K shown in the figure include the red second sub-pixel 2*sp*R, the green second sub-pixel 2*sp*G, and the blue second sub-pixel 2*sp*B.

At step S702, the data for displaying a same color in the image data corresponding to the image block is processed according to a weighted operation rule to obtain weighted data for displaying red, weighted data for displaying green, and weighted data for displaying blue. The weighted operation rule lies in that according to the correspondence between the image block and the second display area, the data for displaying the same color being closer to the second sub-pixel of the same color leads to the larger weight applied in the weighted operation.

After the image corresponding to the second area original image data is divided into a plurality of image blocks, each image block corresponds to a partial area of the second display area. The weighted operation rule used in this embodiment of the present disclosure will be described by using the correspondence between the image block K and the second display area AA2 shown in FIG. 16. Taking calculation of weighted data for displaying red as an example, as shown in the figure, according to the correspondence, a corresponding position of the red sub-pixel 2*sp*R in the image block K is substantially a position of the red sub-pixel pR1, then the four red sub-pixels in the image block K are respectively the red sub-pixel pR1, the red sub-pixel pR3, the red sub-pixel pR2, and the red sub-pixel pR4, in an order from small to large in terms of a distance to the red second sub-pixel 2*sp*R. In an embodiment, a respective weight coefficient is assigned to each of the four sub-pixels. The weight coefficient corresponding to the red sub-pixel pR1 is 0.8, the weight coefficient corresponding to the red sub-pixel pR3 is 0.2, the weight coefficient corresponding to the red sub-pixel pR2 is 0.05, and the weight coefficient corresponding to the red sub-pixel pR4 is 0.05. The data signal corresponding to the red sub-pixel pR1 is V7, the data signal corresponding to the red sub-pixel pR2 is V8, the data signal corresponding to the red sub-pixel pR3 is V9, and the data signal corresponding to the red sub-pixel pR4 is V10. For example, the data signals are voltage values. Then, a weighted operation rule is used for processing to obtain that weighted data for displaying red is V=0.8*V7+0.2*V9+0.05*V8+0.05*V10. Correspondingly, the weighted data for displaying green and the weighted data for displaying blue can be calculated by using the above-mentioned weighted operation rule, and details will not be further described herein.

At step S703, the weighted data for displaying red, the weighted data for displaying green, and the weighted data for displaying blue corresponding to one image block blue are combined to form processed image block data;

At step S704, multiple pieces of processed image block data are integrated to obtain second image pixel data.

In the display method provided by this embodiment, after the image corresponding to the second original image data is divided into image blocks, the data corresponding to the image block is processed by using the weighted operation rule according to the correspondence between the image block and the second display area. Since the sub-pixel density of the second display area is smaller than the sub-pixel density of the corresponding original image, and at this time the sub-pixel rendering is not used in the second display area to perform display, when forming the correspondence between the image block and the second display area, the second sub-pixels of various colors in the second display area can get their corresponding positions in the image block. Then, the respective weights in the weighted operation can be determined based on the respective distances to the corresponding positions, and the smaller the distance is, the larger the weight is. In this implementation for processing the second area original image data, an actual arrangement of the second sub-pixels in the second display area is involved, which can achieve that an image actually displayed in the second display area is very close to a display effect of the original image. At the same time, in this implementation, the number of data signals in the second image data is the same as the number of second sub-pixels, and after being processed by using the second operation rule, the pixel sharing manner is not used in the second display area to perform display. All of the data signals provided to the second display area can be received by the second sub-pixels, and no data signal will be aligned to a position where no sub-pixel is arranged. Therefore, the data signals corresponding to sub-pixels of different colors in the pixel units of the second display area are complete, and there is no loss of data signals, thereby avoiding the problem of color shift in the related art due to the same display algorithm being adopted in the first display area and the second display area for displaying.

Figure 17:
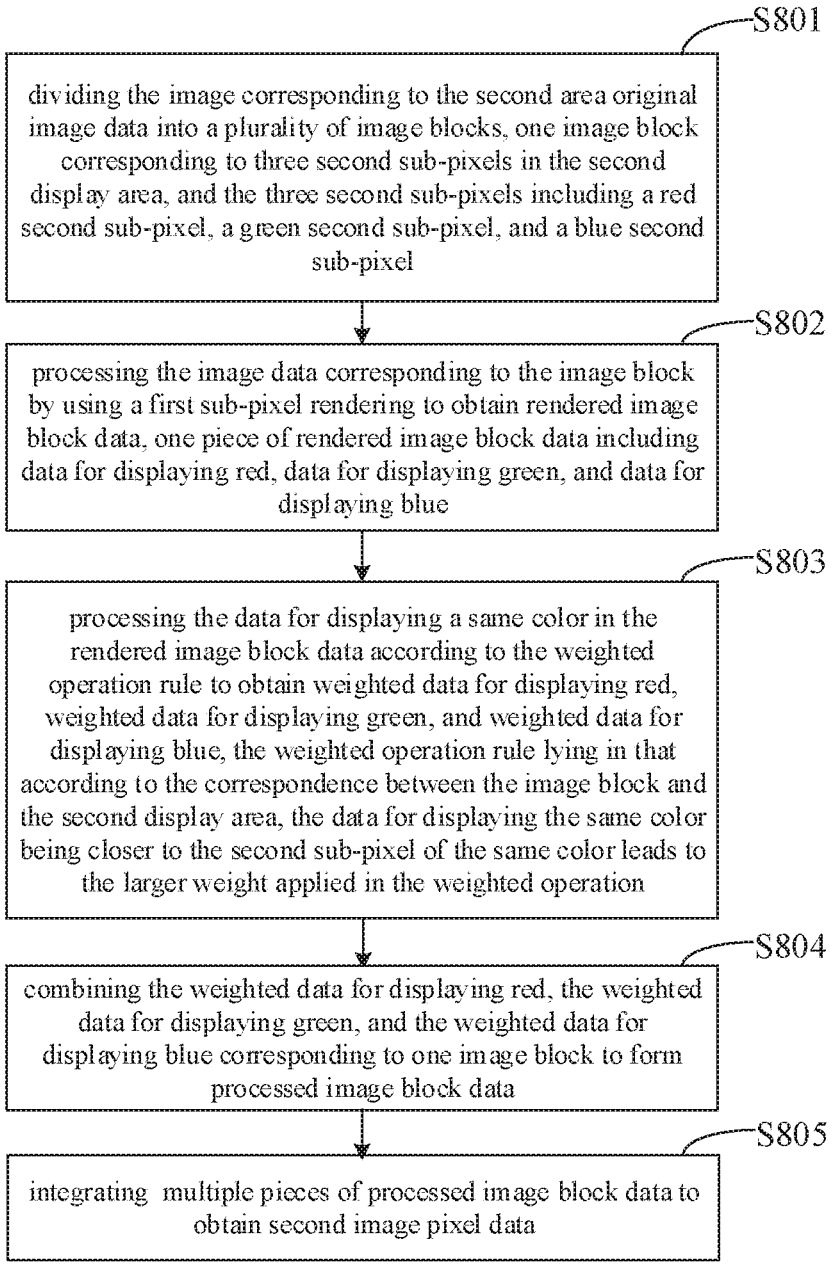
FIG. 17 is a flowchart of another implementation of processing second area original image data by using a display method according to an embodiment of the present disclosure.

FIG. 17 is a flowchart of another implementation of processing second area original image data by using a display method according to an embodiment of the present disclosure. As shown in FIG. 17, the second area original image data being processed by using the second operation rule to obtain the second image data includes following steps.

At step S801, the image corresponding to the second area original image data is divided into a plurality of image blocks, and one image block corresponds to three second sub-pixels in the second display area. The three second sub-pixels include a red second sub-pixel, a green second sub-pixel, and a blue second sub-pixel.

At step S802, the image data corresponding to the image block is processed by using a first sub-pixel rendering to obtain rendered image block data. One piece of rendered image block data includes data for displaying red, data for displaying green, and data for displaying blue. In this implementation, after the image corresponding to the second area original image data is divided, first the image data corresponding to the image block is processed by using the first sub-pixel rendering, that is, at this time, first the image block is processed by using the same rendering algorithm as that of the first display area. The sub-pixel density of the image corresponding to the rendered image block data obtained after processing is the same as the sub-pixel density of the first display area. Subsequently, data processing is further performed on the rendered image block data.

At step S803, the data for displaying a same color in the rendered image block data is processed according to the weighted operation rule to obtain weighted data for displaying red, weighted data for displaying green, and weighted data for displaying blue. The weighted operation rule lies in that according to the correspondence between the image block and the second display area, the data for displaying the same color being closer to the second sub-pixel of the same color leads to the larger weight applied in the weighted operation. Reference can be made to the description corresponding to FIG. 16 for the weighted operation rule, which will not be further described herein.

At step S804, the weighted data for displaying red, the weighted data for displaying green, and the weighted data for displaying blue corresponding to one image block are combined to form processed image block data.

At step S805, multiple pieces of processed image block data are integrated to obtain second image pixel data.

This implementation is applicable to a case in which the sub-pixel density of the second display area is highly different from the sub-pixel density of the original image. First, the divided image blocks are processed by using the same rendering algorithm as that of the first display area, then the sub-pixel density of the image corresponding to the rendered image block data obtained after processing is the same as the sub-pixel density of the first display area. Then, the rendered image block data is processed by using the weighted operation rule to obtain the weighted data for displaying each color. Finally, multiple pieces of processed image block data are re-integrated into new image data (i.e., the second image pixel data) according to a previous division rule. At this time, a number of data signals in the second image data is the same as a number of second sub-pixels, and after being processed by using the second operation rule, no pixel sharing manner is applied in the second display area to perform display. All of the data signals provided to the second display area can be received by the second sub-pixels, and no data signal will be aligned to a position where no sub-pixel is arranged. Therefore, the data signals corresponding to sub-pixels of different colors in the pixel units of the second display area are complete, and there is no loss of data signals, thereby avoiding the problem of color shift in the related art due to the same display algorithm being adopted in the first display area and the second display area for displaying. Moreover, in this implementation for processing the second area original image data, an actual arrangement of the second sub-pixels in the second display area is involved, which can achieve that an image actually displayed in the second display area is very close to a display effect of the original image.

Figure 18:
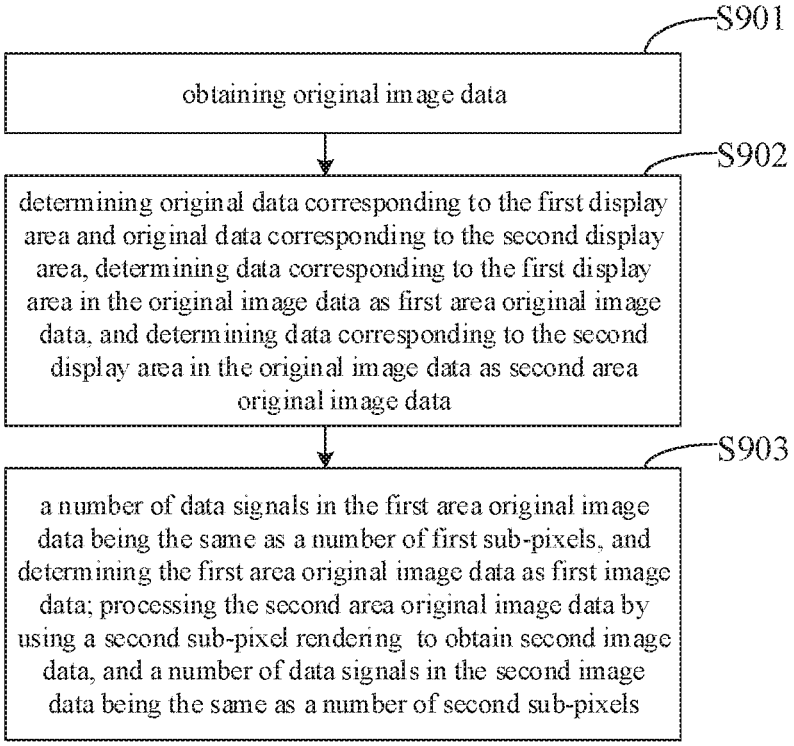
FIG. 18 is a flowchart of another implementation of a display method according to an embodiment of the present disclosure.

In some implementations, in the display method provided by an embodiment of the present disclosure, the sub-pixel rendering is not used in the first display area to perform display, and is used in the second display area to perform display. FIG. 18 is a flowchart of another implementation of a display method according to an embodiment of the present disclosure. As shown in FIG. 18, the display method includes following steps.

At step S901, original image data is obtained.

At step S902, original data corresponding to the first display area and original data corresponding to the second display area are determined. Data corresponding to the first display area in the original image data is determined as first area original image data, and data corresponding to the second display area in the original image data is determined as second area original image data.

At step S903, a number of data signals in the first area original image data is the same as a number of first sub-pixels, and the first area original image data is determined as first image data; the second area original image data is processed by using a second sub-pixel rendering to obtain second image data, and a number of data signals in the second image data is the same as a number of second sub-pixels.

Figure 19:
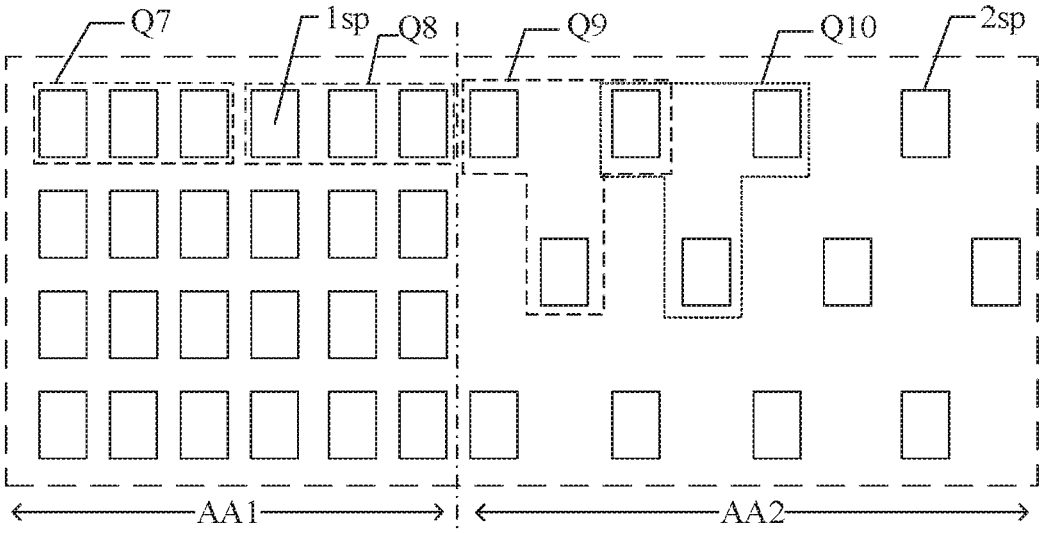
FIG. 19 is a schematic diagram of a display panel for displaying by using the display method in the embodiment of FIG. 18.

In this implementation, the sub-pixel rendering is not used in the first display area to perform display, and is used in the second display area to perform display. FIG. 19 is a schematic diagram of a display panel for displaying by using the display method in the embodiment of FIG. 18. As shown in FIG. 19, an arrangement density of second sub-pixels 2*sp* in the second display area AA2 is smaller than an arrangement density of first sub-pixels 1*sp* in the first display area AA1. During display, in a first display area AA1, three first sub-pixels 1*sp* in an area Q7 constitute one-pixel unit, three first sub-pixels 1*sp* in an area Q8 constitute one-pixel unit, and these two-pixel units are adjacent to each other and do not share the first sub-pixel. In a second display area AA2, three second sub-pixels 2*sp* in an area Q9 constitute one-pixel unit, three second sub-pixels 2*sp* in an area Q10 constitute one-pixel unit, and these two-pixel units are adjacent to each other and share one second sub-pixel. In this implementation, display of accurate colors can be achieved in both the first display area and the second display area, thereby avoiding the problem of color shift in the related art due to the same display algorithm being adopted in the first display area and the second display area for displaying. In addition, since the sub-pixel density of the second display area is smaller than the sub-pixel density of the first display area, a resolution of the second display area will be smaller than a resolution of the first display area. The sub-pixel rendering is not used in the first display area to perform display, and is used in the second display area to perform display, so that the visual resolution of the second display area can be improved, thereby reducing a difference in visual resolution between the first display area and the second display area and thus improving the display effect.

In some implementations, the display method provided in an embodiment of the present disclosure further includes: performing gamma correction processing on the first image data to obtain first gamma image data, and providing the first gamma image data to the first display area; performing gamma correction processing on the second image data to obtain second gamma image data, and providing the second gamma image data to the second display area. In the display method provided in this implementation, for example, the first image data and the second image data may be corrected by using a same gamma correction curve or may be corrected by using different gamma correction curves. When different gamma correction curves are used for correction, brightness of the sub-pixels in the second display area can be compensated by gamma correction to increase the brightness of the second sub-pixels and thus increase brightness of the second display area, thereby reducing a brightness difference between the second display area and the first display area caused by the decreased density of the second display area.

Figure 20:
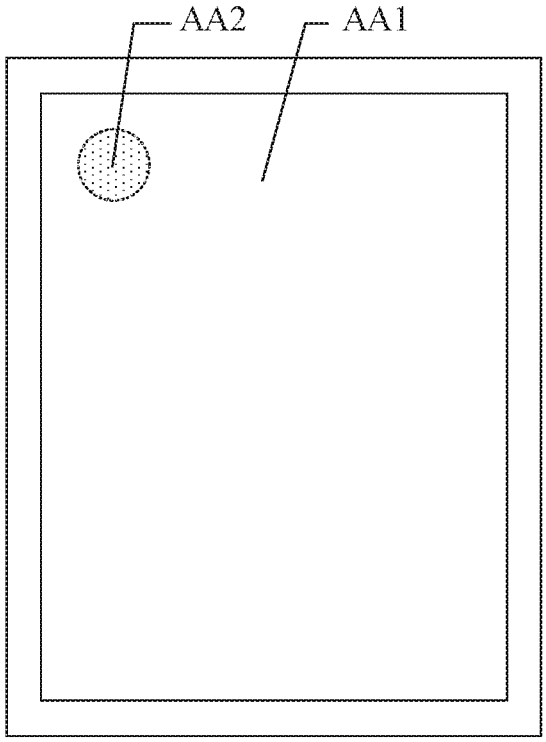
FIG. 20 is a schematic diagram of a display panel according to an embodiment of the present disclosure.

An embodiment of the present disclosure further provides a display panel. FIG. 20 is a schematic diagram of a display panel according to an embodiment of the present disclosure. As shown in FIG. 20, the display area includes a first display area AA1 and a second display area AA2. The sub-pixel density of the second display area AA2 is smaller than the sub-pixel density of the first display area AA1. In FIG. 20, a shape of the second display area AA2, and a spatial relationship between the second display area AA2 and the first display area AA1 are merely schematic, and are not intended to limit the present disclosure. The display panel provided by this embodiment of the present disclosure performs display by using the display method provided by any one of embodiments described above. The display method has been described in the details in the above embodiments, and will not be repeated herein.

Figure 21:
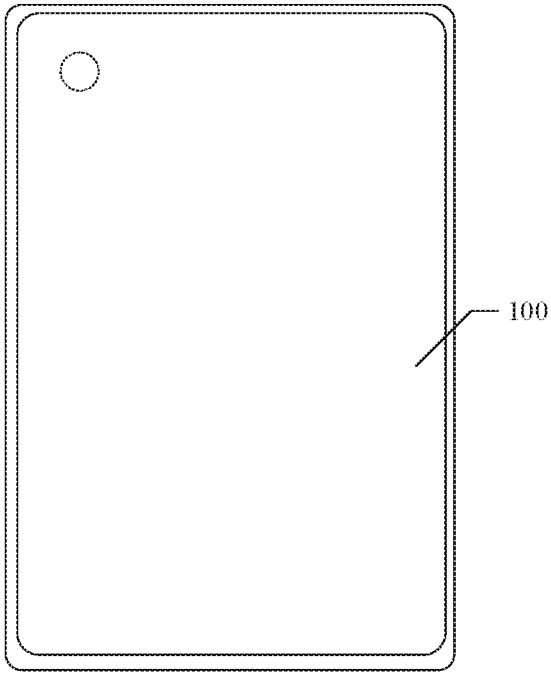
FIG. 21 is a schematic diagram of a display device according to an embodiment of the present disclosure.

An embodiment of the present disclosure further provides a display device. FIG. 21 is a schematic diagram of a display device provided by an embodiment of the present disclosure. As shown in FIG. 21, the display device includes the display panel 100 provided by any embodiment of the present disclosure. It should be noted that the display device shown in FIG. 21 is merely schematic, and the display device can be any electronic device with a display function, such as a mobile phone, a tablet computer, a notebook computer, an electronic paper book, or a television.

In some implementations, the display device further includes an optical element, and the optical element overlaps the second display area in a direction perpendicular to a plane where the display panel is located. Optionally, the optical element may be an optical sensor, a camera, or the like.

The above-described embodiments are merely preferred embodiments of the present disclosure and are not intended to limit the present disclosure. Any modifications, equivalent substitutions and improvements made within the principle of the present disclosure shall fall into the protection scope of the present disclosure.

What is claimed is:

1. A display method of a display panel, wherein the display panel has a display area, and the display area comprises a first display area and a second display area, wherein sub-pixels provided in the display area comprise first sub-pixels and second sub-pixels, wherein the first sub-pixels are located in the first display area and the second sub-pixels axe located in the second display area, and a sub-pixel density of the second display area is smaller than a sub-pixel density of the first display area; wherein the display panel comprises a pixel circuit electrically connected to the sub-pixels to drive the sub-pixels to perform display, the display method comprising:

in displaying one frame of an image, performing display in the first display area and the second display area by using different display algorithms, wherein a sub-pixel rendering is used to perform display in at least one of the first display area and the second display area, wherein a number of data signals provided to the first display area and a number of the first sub-pixels are identical, wherein a number of data signals provided to the second display area and a number of the second sub-pixels are identical, and when the pixel circuit drives the sub-pixels to perform display, a voltage signal written by a data line to the pixel circuit is determined as a data signal;

wherein said performing display in the first display area and the second display area by using different display algorithms comprises:

obtaining original image data;

determining, from the original image data, first area original image data corresponding to the first display area and second area original image data corresponding to the second display area; and processing the first area original image data by using a first display algorithm, and processing the second area original image data by using a second display algorithm;

wherein said determining the first area original image data corresponding to the first display area and the second area original image data corresponding to the second display area comprises:

determining the sub-pixel density of the first display area as a preset sub-pixel density;

generating a mapping rule between the display area and the original image data based on the preset sub-pixel density; and obtaining the first area original image data and the second area original image data based on the mapping rule.

2. The display method according to claim 1, wherein said processing the first area original image data by using the first display algorithm comprises: processing the first area original image data by using a first sub-pixel rendering to obtain first image data, a number of data signals in the first image data and the number of the first sub-pixels being identical, and said processing the second area original image data by using the second display algorithm comprises: processing the second area original image data by using a second sub-pixel rendering to obtain second image data, a number of data signals in the second image data and the number of the second sub-pixels being identical.

3. The display method according to claim 2, further comprising:

performing gamma correction processing on the first image data to obtain first gamma image data, and providing the first gamma image data to the first display area; and performing gamma correction processing on the second image data to obtain second gamma image data, and providing the second gamma image data to the second display area.

4. The display method according to claim 1, wherein said processing the first area original image data by using the first display algorithm comprises: processing the first area original image data by using a first sub-pixel rendering to obtain first image data, a number of data signals in the first image data and the number of the first sub-pixels being identical, and said processing the second area original image data by using the second display algorithm comprises: processing the second area original image data by using a second operation rule to obtain second image data, a number of data signals in the second image data and the number of the second sub-pixels being identical, and no pixel sharing manner is applied in the second display area to perform display after said processing by using the second operation rule.

5. The display method according to claim 4, wherein said processing the second area original image data by using the second operation rule to obtain the second image data comprises:

dividing an image corresponding to the second area original image data into a plurality of image blocks, wherein image data corresponding to one image block of the plurality of image blocks comprises data for displaying red, data for displaying green, and data for displaying blue; the one image block corresponds to three second sub-pixels in the second display area, and the three second sub-pixels comprise a red second sub-pixel, a green second sub-pixel, and a blue second sub-pixel;

summing up and then averaging data for displaying a same color in the image data corresponding to the one image block to obtain average data for displaying red, average data for displaying green, and average data for displaying blue;

combining the average data for displaying red, the average data for displaying green, and the average data for displaying blue corresponding to the one image block to form processed image block data; and integrating multiple pieces of processed image block data to obtain the second image data.

6. The display method according to claim 4, wherein said processing the second area original image data by using the second operation rule to obtain the second image data comprises:

dividing an image corresponding to the second area original image data into a plurality of image blocks, wherein one image block of the plurality of image blocks corresponds to three second sub-pixels in the second display area, and the three second sub-pixels comprise a red second sub-pixel, a green second sub-pixel, and a blue second sub-pixel;

processing image data corresponding to the one image block by using the first sub-pixel rendering to obtain rendered image block data, wherein one piece of the rendered image block data comprises data for displaying red, data for displaying green and data for displaying blue;

summing up and then averaging data for displaying a same color in the rendered image block data to obtain average data for displaying red, average data for displaying green, and average data for displaying blue;

combining the average data for displaying red, the average data for displaying green, and the average data for displaying blue corresponding to the one image block to form processed image block data; and integrating multiple pieces of processed image block data to obtain the second image data.

7. The display method according to claim 4, wherein said processing the second area original image data by using the second operation rule to obtain the second image data comprises:

dividing an image corresponding to the second area original image data into a plurality of image blocks, wherein image data corresponding to one image block of the plurality of image blocks comprises data for displaying red, data for displaying green, and data for displaying blue; the one image block corresponds to three second sub-pixels in the second display area, and the three second sub-pixels compose a red second sub-pixel, a green second sub-pixel, and a blue second sub-pixel;

processing data for displaying a same color in image data corresponding to the one image block based on a weighted operation rule to obtain weighted data for displaying red, weighted data for displaying green, and weighted data for displaying blue, wherein the weighted operation rule lies in that the data for displaying the same color being closer to the second sub-pixel of the same color leads to a larger weight applied in a weighted operation based on a correspondence between the one image block and the second display area;

combining the weighted data for displaying red, the weighted data for displaying green, and the weighted data for displaying blue corresponding to the one image block to form processed image block data; and integrating multiple pieces of processed image block data to obtain the second image data.

8. The display method according to claim 4, wherein said processing the second area original image data by using the second operation rule to obtain the second image data comprises:

dividing an image corresponding to the second area original image data into a plurality of image blocks, wherein one image block of the plurality of image blocks corresponds to three second sub-pixels in the second display area, and the three second sub-pixels comprise a red second sub-pixel, a green second sub-pixel, and a blue second sub-pixel;

processing image data corresponding to the one image block by using the first sub-pixel rendering to obtain rendered image block data, wherein one piece of rendered image block data comprises data for displaying red, data for displaying green and data for displaying blue;

processing data for displaying a same color in the rendered image block data according to a weighted operation rule to obtain weighted data for displaying red, weighted data for displaying green, and weighted data for displaying blue, wherein the weighted operation rule lies in that the data for displaying the same color being closer to the second sub-pixel of the same color leads to a larger weight applied in a weighted operation based on a correspondence between the one image block and the second display area;

combining the weighted data for displaying red, the weighted data for displaying green, and the weighted data for displaying blue corresponding to the one image block to form processed image block data; and integrating multiple pieces of processed image block data to obtain the second image data.

9. The display method according to claim 4, further comprising:

performing gamma correction processing on the first image data to obtain first gamma image data, and providing the first gamma image data to the first display area; and performing gamma correction processing on the second image data to obtain second gamma image data, and providing the second gamma image data to the second display area.

10. The display method according to claim 1, wherein said processing the first area original image data by using the first display algorithm comprises:

determining the first area original image data as first image data, wherein a number of data signals in the first area original image data and the number of the first sub-pixels are identical, and said processing the second area original image data by using the second display algorithm comprises:

processing the second area original image data by using a second sub-pixel rendering to obtain second image data, wherein a number of data signals in the second image data and the number of the second sub-pixels are identical.

11. The display method according to claim 10, further comprising:

performing gamma correction processing on the first image data to obtain first gamma image data, and providing the first gamma image data to the first display area; and performing gamma correction processing on the second image data to obtain second gamma image data, and providing the second gamma image data to the second display area.

12. A display panel for performing display by using a display method, wherein the display panel has a display area, and the display area comprises a first display area and a second display area, wherein sub-pixels provided in the display area comprise first sub-pixels and second sub-pixels, wherein the first sub-pixels are located in the first display area and the second sub-pixels are located in the second display area, and a sub-pixel density of the second display area is smaller than a sub-pixel density of the first display area; wherein the display panel comprises a pixel circuit electrically connected to the sub-pixels to drive the sub-pixels to perform display, the display method comprising:

in displaying one frame of image, performing display in the first display area and the second display area by using different display algorithms, wherein a sub-pixel rendering is used to perform display in at least one of the first display area and the second display area, wherein a number of data signals provided to the first display area and a number of the first sub-pixels are identical, a number of data signals provided to the second display area and a number of the second sub-pixels are identical, and when the pixel circuit drives the sub-pixels to perform display, a voltage signal written by a data line to the pixel circuit is determined as a data signal;

wherein said performing display in the first display area and the second display area by using different display algorithms comprises:

obtaining original image data;

determining, from the original image data, first area original image data corresponding to the first display area and second area original image data corresponding to the second display area; and processing the first area original image data by using a first display algorithm, and processing the second area original image data by using a second display algorithm;

wherein said determining the first area original image data corresponding to the first display area and the second area original image data corresponding to the second display area comprises:

determining the sub-pixel density of the first display area as a preset sub-pixel density;

generating a mapping rule between the display area and the original image data based on the preset sub-pixel density; and obtaining the first area original image data and the second area original image data based on the mapping rule.

13. A display device, comprising a display panel for performing display by using a display method, wherein the display panel has a display area, and the display area comprises a first display area and a second display area, wherein sub-pixels provided in the display area comprise first sub-pixels and second sub-pixels, wherein the first sub-pixels are located in the first display area and the second sub-pixels are located in the second display area, and a sub-pixel density of the second display area is smaller than a sub-pixel density of the first display area; the display panel comprises a pixel circuit electrically connected to the sub-pixels to drive the sub-pixels to perform display, the display method comprising:

in displaying one frame of an image, performing display in the first display area and the second display area by using different display algorithms, wherein a sub-pixel rendering is used to perform display in at least one of the first display area and the second display area, wherein a number of data signals provided to the first display area and a number of the first sub-pixels are identical, a number of data signals provided to the second display area and a number of the second sub-pixels are identical, and when the pixel circuit drives the sub-pixels to perform display, a voltage signal written by a data line to the pixel circuit is determined as a data signal voltage signal written by a data line to the pixel circuit is determined as a data signal;

wherein said performing display in the first display area and the second display area by using different display algorithms comprises:

obtaining original image data;

determining, from the original image data, first area original image data corresponding to the first display area and second area original image data corresponding to the second display area; and processing the first area original image data by using a first display algorithm, and processing the second area original image data by using a second display algorithm;

wherein said determining the first area original image data corresponding to the first display area and the second area original image data corresponding to the second display area comprises:

determining the sub-pixel density of the first display area as a preset sub-pixel density;

generating a mapping rule between the display area and the original image data based on the preset sub-pixel density; and obtaining the first area original image data and the second area original image data based on the mapping rule.

14. The display device according to claim 13, further comprising an optical element, wherein the optical element overlaps the second display area, in a direction perpendicular to a plane of the display panel.

* * * * *